US010961676B2

(12) United States Patent
Fu et al.

(10) Patent No.: US 10,961,676 B2
(45) **Date of Patent: *Mar. 30, 2021**

(54) SNOW THROWER

(71) Applicant: Chervon (HK) Limited, Wanchai (HK)

(72) Inventors: Xiangqing Fu, Nanjing (CN); Feng Yuan, Nanjing (CN); Keqiong Zhong, Nanjing (CN); Qian Liu, Nanjing (CN); Li Li, Nanjing (CN); Toshinari Yamaoka, Nanjing (CN); Fangjie Nie, Nanjing (CN); Liang Chen, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 0 days.

This patent is subject to a terminal disclaimer.

(21) Appl. No.: 17/005,673

(22) Filed: Aug. 28, 2020

(65) Prior Publication Data

US 2020/0392685 A1 Dec. 17, 2020

Related U.S. Application Data

(63) Continuation of application No. 16/559,349, filed on Sep. 3, 2019, now Pat. No. 10,760,230, which is a continuation of application No. 15/363,589, filed on Nov. 29, 2016, now Pat. No. 10,428,479.

(30) Foreign Application Priority Data

| | | |
|---|---|---|
| Nov. 30, 2015 | (CN) | 201510854107.7 |
| Nov. 30, 2015 | (CN) | 201510854109.6 |
| Nov. 30, 2015 | (CN) | 201510857068.6 |
| Nov. 30, 2015 | (CN) | 201510857069.0 |
| Nov. 30, 2015 | (CN) | 201520973240.X |
| Aug. 26, 2016 | (CN) | 201620971610.0 |

(51) Int. Cl.
*E01H 5/09* (2006.01)
*E01H 5/04* (2006.01)

(52) U.S. Cl.
CPC ..... *E01H 5/098* (2013.01); *E01H 5/045* (2013.01)

(58) Field of Classification Search
CPC ..... E01H 5/04; E01H 5/045; E01H 5/098
See application file for complete search history.

(56) References Cited

U.S. PATENT DOCUMENTS

| | | | |
|---|---|---|---|
| RE26,010 | E | 5/1966 | Rubin |
| 3,484,963 | A | 12/1969 | Munson |
| 3,488,869 | A | 1/1970 | Munson |

(Continued)

FOREIGN PATENT DOCUMENTS

| | | | |
|---|---|---|---|
| CN | 1455703 | A | 11/2003 |
| CN | 200943197 | Y | 9/2007 |

(Continued)

OTHER PUBLICATIONS

CIPO, Office Action issued on Canadian patent application No. 2,950,174, received Sep. 26, 2017, 6 pages.

*Primary Examiner* — Jamie L McGowan
(74) *Attorney, Agent, or Firm* — Greenberg Traurig, LLP

(57) ABSTRACT

A snow thrower includes a motor, an auger driven by the motor to rotate, a handle device for a user to operate, an auger housing for containing the auger and a frame for connecting the handle device and the auger housing. The auger housing is made of at least two different materials.

20 Claims, 30 Drawing Sheets

(56) References Cited

U.S. PATENT DOCUMENTS

| | | | | |
|---|---|---|---|---|
| 3,742,626 | A | 7/1973 | Ellis | |
| 4,062,135 | A | 12/1977 | Dobberpuhl | |
| 4,457,086 | A | 7/1984 | Bacon | |
| 4,761,901 | A | 8/1988 | Szafarz | |
| 5,163,239 | A | 11/1992 | Lampe | |
| 5,438,770 | A | 8/1995 | Miller | |
| 6,952,893 | B1 | 10/2005 | Sanderson | |
| 7,051,461 | B2 | 5/2006 | Itou et al. | |
| 7,540,102 | B2 | 6/2009 | Olmr | |
| 7,735,246 | B2 | 6/2010 | Kaskawitz | |
| 8,844,172 | B2 | 9/2014 | Cmich | |
| 8,938,894 | B2 | 1/2015 | Raasch | |
| 9,290,897 | B2 * | 3/2016 | Schisel | E01H 5/098 |
| 10,428,477 | B2 | 10/2019 | Hiller | |
| 2002/0108274 | A1 | 8/2002 | Dowe | |
| 2002/0174572 | A1 | 11/2002 | Prochnow | |
| 2002/0189137 | A1 | 12/2002 | Cox | |
| 2007/0084091 | A1 | 4/2007 | Umemura | |
| 2007/0084092 | A1 | 4/2007 | Velin | |
| 2008/0163520 | A1 | 7/2008 | White | |
| 2008/0209771 | A1 | 9/2008 | Jerger | |
| 2011/0094129 | A1 | 4/2011 | Rowe | |
| 2012/0198732 | A1 | 8/2012 | Ferrell | |
| 2014/0096418 | A1 | 4/2014 | Kaskawitz | |
| 2014/0102241 | A1 | 4/2014 | Rao | |
| 2014/0150302 | A1 | 6/2014 | Mast | |
| 2014/0157633 | A1 | 6/2014 | Hansen | |
| 2015/0007461 | A1 | 1/2015 | Schmalz | |
| 2015/0007462 | A1 | 1/2015 | Cohen | |
| 2015/0013196 | A1 | 1/2015 | Strange | |
| 2015/0068074 | A1 | 3/2015 | Mast | |
| 2015/0218764 | A1 | 8/2015 | Schisel | |
| 2016/0340847 | A1 | 11/2016 | Eavenson | |
| 2018/0347803 | A1 | 12/2018 | Dimsey | |

FOREIGN PATENT DOCUMENTS

| | | | |
|---|---|---|---|
| CN | 203462429 | U | 3/2014 |
| CN | 104972883 | A | 10/2015 |
| JP | 0530602 | A | 2/1993 |

* cited by examiner

A-A

SNOW THROWER

CROSS REFERENCE TO RELATED APPLICATION

This application is a continuation of U.S. patent application Ser. No. 16/559,349 filed on Sep. 3, 2019, now U.S. Pat. No. 10,760,230, which is a continuation of U.S. patent application Ser. No. 15/363,589 filed on Nov. 29, 2016, now U.S. Pat. No. 10,428,479, entitled "Snowthrower", which claims the benefit under 35 U.S.C. § 119(a) of Chinese Patent Application No. CN 201510854109.6, filed on Nov. 30, 2015, Chinese Patent Application No. CN 201510857069.0, filed on Nov. 30, 2015, Chinese Patent Application No. CN 201510854107.7, filed on Nov. 30, 2015, Chinese Patent Application No. CN 201620971610.0, filed on Aug. 26, 2016, Chinese Patent Application No. CN 201510857068.6, filed on Nov. 30, 2015, and Chinese Patent Application No. CN 201520973240.X, filed on Nov. 30, 2015, each of which is incorporated herein by reference in its entirety.

FIELD OF THE DISCLOSURE

The present disclosure relates generally to snow removing appliances and, more particularly, to a snow thrower.

BACKGROUND OF RELATED ART

Snow throwers as a kind of hand pushed power tools are important appliances for removing snow in winter, which have advantages such as high efficiency, economy and environmental protection, etc. With the economy growing and the society developing, snow throwers are used widely both at home and abroad.

At present, small snow throwers commonly include a housing, an operating handle, wheels, a battery pack, a motor, an auger and a chute device.

For the battery pack and the motor, they generate lots of heat during working. If the heat isn't managed effectively for a long time, the snow thrower may be damaged.

For the currently known snow throwers, when the auger is rotated, it throws the snow to the chute device directly. It is clear that, most snow can't be thrown to the chute device exactly and therefore, the effect of snow throwing is bad. Otherwise, the currently known snow throwers have low strength and are easy to damage.

Commonly, the chute device is capable of rotating so as to adjust the throwing angle. However, the currently known angle adjusting device is inconvenient to operate, which affects the working efficiency.

Otherwise, when there are wires extending into the housing from the outside, if it is needed to examine and repair the components within the housing, the housing is difficult to remove due to the limitation of the wires. Thus, the maintenance is inconveniently.

Sometimes the snow thrower is needed to work in the evening. However, the vision in the evening is poor. So, the safety of the user can't be ensured and the effect of the snow throwing is affected.

The operating handle is capable of rotating relative to the housing. However, if the user releases the operating handle during rotation, it will drop down quickly so as to damage the operating handle and the housing.

The statements in this section merely provide background information related to the present disclosure and may not constitute prior art.

SUMMARY

In one aspect of the disclosure, a snow thrower includes a motor, an auger driven by the motor to rotate, a handle device for a user to operate, an auger housing for containing the auger and a frame for connecting the handle device and the auger housing. The auger housing is made of at least two different materials.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustrative purposes only of selected examples and not all possible implementations and are not intended to limit the scope of the present disclosure. Corresponding reference numerals indicate corresponding parts throughout the several views of the drawings.

DETAILED DESCRIPTION

The following disclosure of example methods and apparatus is not intended to limit the scope of the disclosure to the precise form or forms detailed herein. Instead the following disclosure is intended to be illustrative so that others may follow its teachings.

Figure 1:
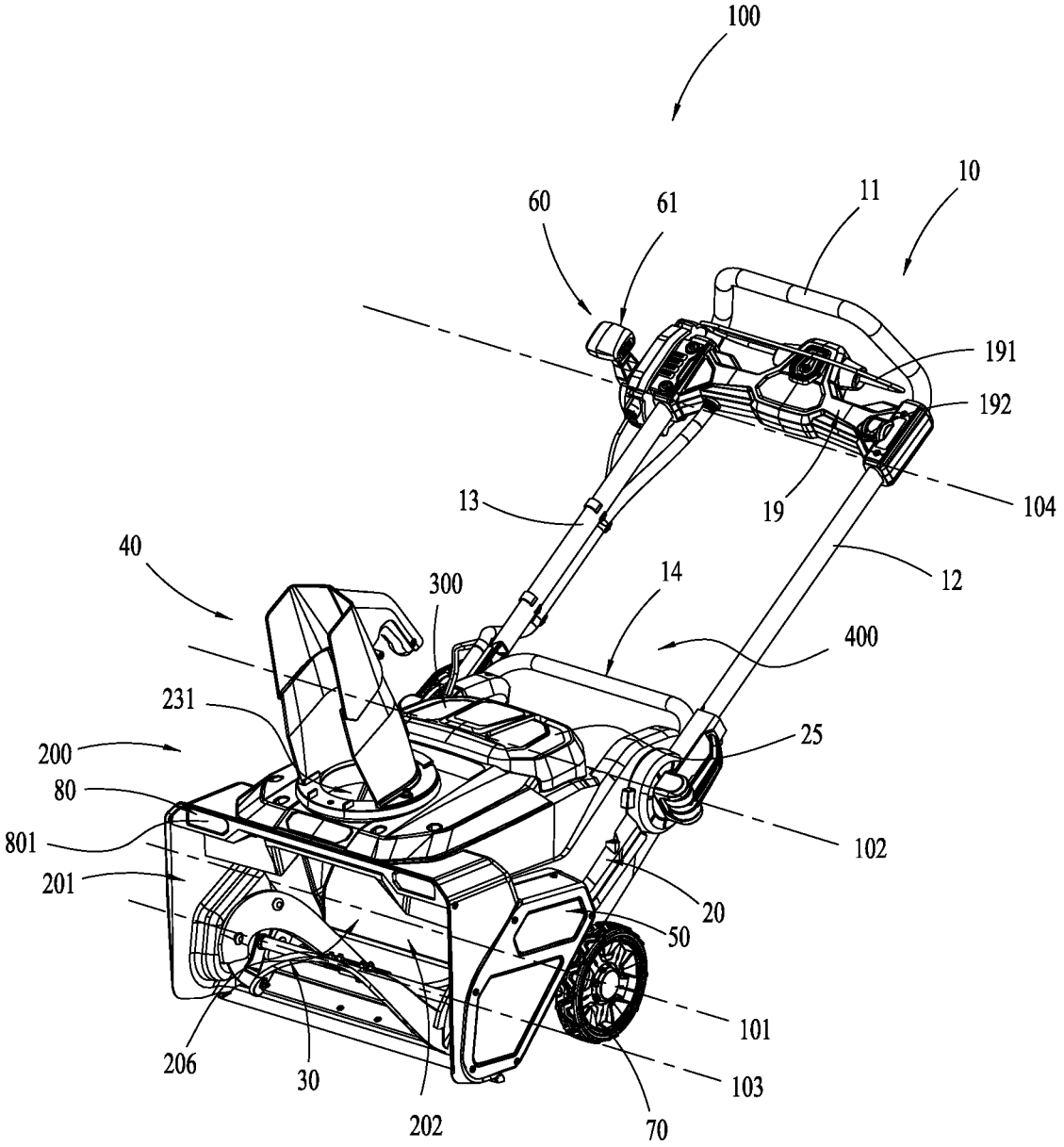
FIG. 1 is a schematic view of an exemplary snow thrower.

As an example, a power tool described hereinafter is a hand-push power tool. The power tool includes a functional element for realizing the function of a tool. As shown in FIG. 1, the power tool is a snow thrower 100, in particular a hand-push snow thrower.

The snow thrower 100 includes a handle device 10, a housing assembly 20, an auger 30, a chute device 40, a motor 50, an angle adjusting device 60 and a plurality of wheels 70. The handle device 10 is used for a user to operate. The housing assembly 20 is configured to contain or fix the motor 50. The auger 30 acts as the functional element of the snow thrower 100, which is driven by the motor 50 to rotate so as to realize the function of snow removing. The motor 50 has a rotation axis which is parallel to a third axis 103 of the auger 30. The motor 50 can be an internal combustion engine creating its energy by burning fuel or an electric motor powered by electricity. Specifically, the motor 50 is an electric motor, which is supplied power by a battery pack 300 connected therewith. The plurality of wheels 70 is capable of rotating about a first axis 101 relative to the housing assembly 20 so that the snow thrower 100 can walk on the ground. In other examples, the plurality of wheels 70 can be replaced by tracks. The chute device 40 is configured to change the movement trace of snow and direct the snow to the distance or guide the throwing direction of the snow thrower 100. A main body 200 can realize the function of the power tool. As shown in FIG. 1, the main body 200 of the snow thrower 100 is constituted by the housing assembly 20, the auger 30 and the motor 50, which realizes the function of snow removing. The battery pack 300 is detachably connected with the main body 200. The snow thrower 100 includes an auger housing 201 for containing the auger 30. The auger 30 is rotated within the auger housing 201. The snow thrower 100 further includes a frame 400 for connecting the handle device 10 and the auger housing 201. The housing assembly 20 is fixed on the frame 400. The auger housing 201 is formed with a channel 206, a snow inlet 202 allowing the snow to enter into the channel 206 and a snow outlet 231 allowing the snow to exhaust out of the channel 206. The snow inlet 202 has a size in a direction of the rotation axis of the auger 30 is greater than or equal to 20 inches and less than or equal to 28 inches. Further, the size of the snow inlet 202 is greater than or equal to 20 inches and less than or equal to 24 inches.

As shown in FIG. 1, the handle device 10 includes an operating handle 11 for the user to grip.

Figure 2:
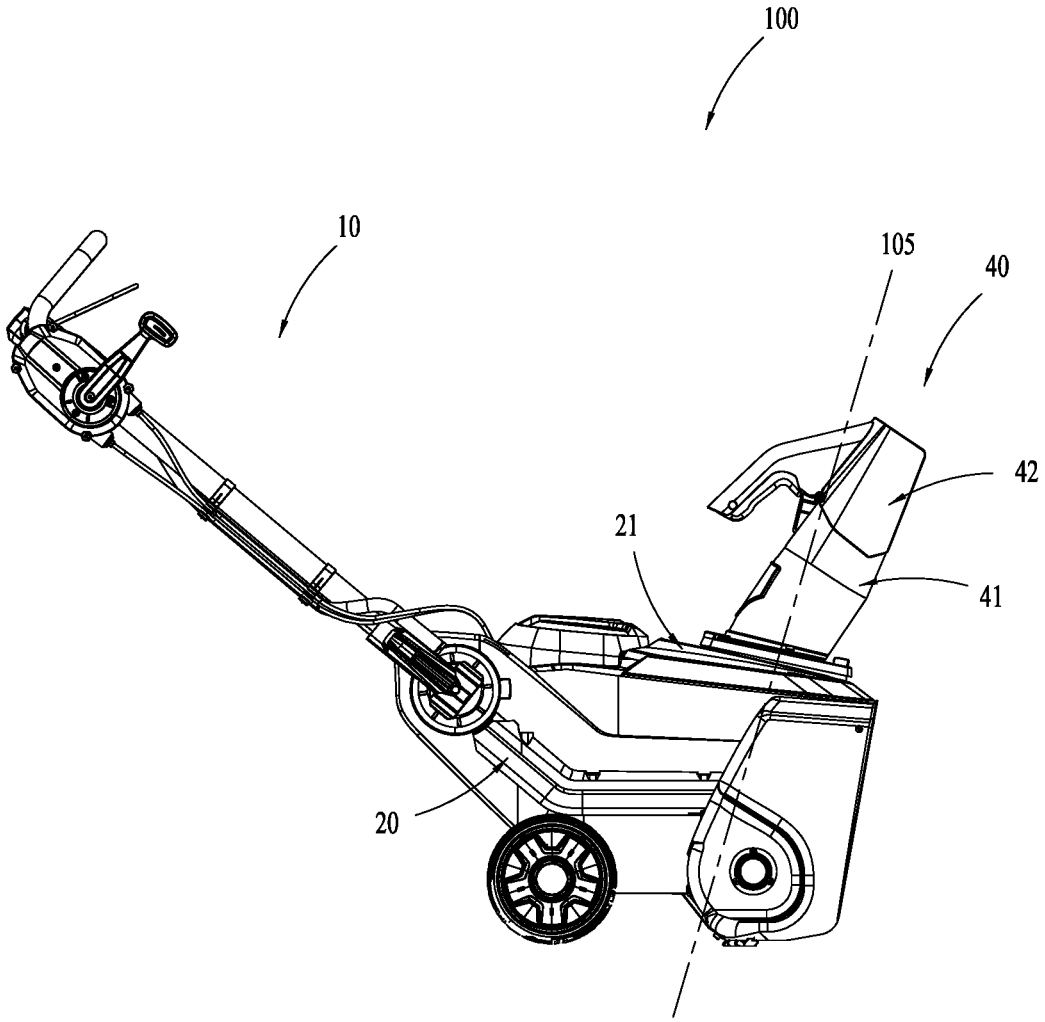
FIG. 2 a plan view of the snow thrower in FIG. 1, wherein the snow thrower is in a snow throwing state.
Figure 3:
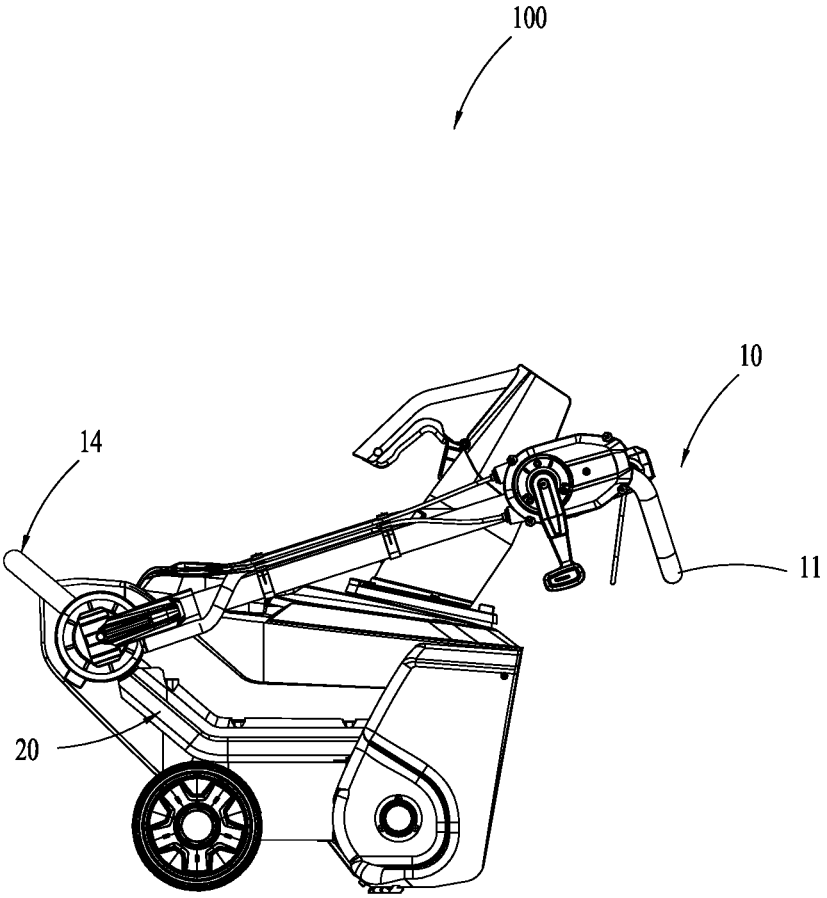
FIG. 3 is a plan view of the snow thrower in FIG. 1, wherein the snow thrower is in a folded state.

The handle device 10 is capable of rotating around a second axis 102 relative to the housing assembly 20. The second axis 102 is substantially parallel to the first axis 101 of the wheels 70 and the third axis 103 of the auger 30. When the handle device 10 is located at a position relative to the housing assembly 20 as shown in FIG. 2, the snow thrower 100 is in a snow throwing state. When the handle device 10 is located at a position relative to the housing assembly 20 as shown in FIG. 3, the snow thrower 100 is in a folded state, so that it can be carried or stored conveniently.

Figure 4:
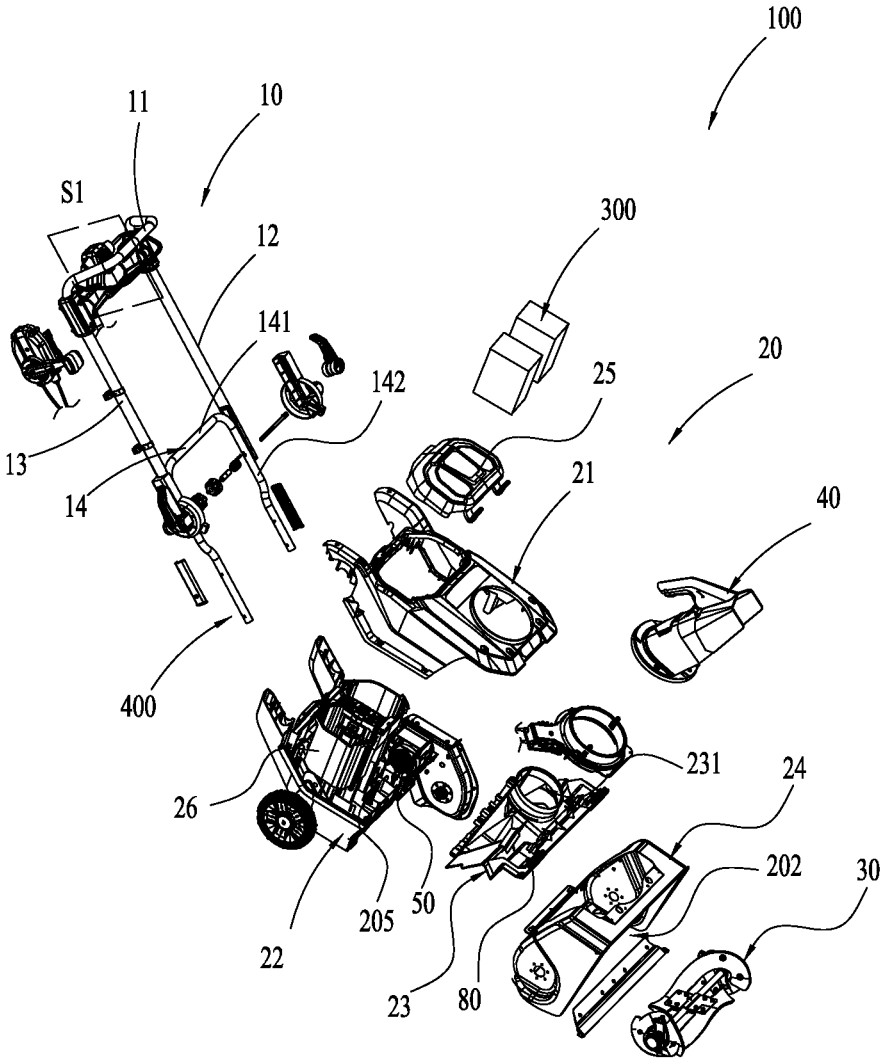
FIG. 4 is an exploded view of the snow thrower in FIG. 1.

As shown in FIG. 4, the handle device 10 includes a first connecting rod 12 and a second connecting rod 13. The first and second connecting rods 12, 13 are connected with two ends of the operating handle 11 respectively. Specifically, the first and second connecting rods 12, 13 are hollow tubes made of aluminum. The operating handle 11 is symmetrical relative to a middle plane S1. Further, the operating handle 11, the first connecting rod 12 and the second connecting rod 13 are symmetrical relative to the middle plane S1. The handle device 10 is symmetrical relative to the middle plane S1. Alternatively, the operating handle 11, the first connecting rod 12 and the second connecting rod 13 constitute a whole which can be one element.

The frame 400 includes an auxiliary rod 14 for connecting the main body 200 and the handle device 10. The auxiliary rod 14 is fixedly connected with the housing assembly 20. One end of the first and second connecting rods 12, 13 is connected with two ends of the operating handle 11 respectively, and the other end of the first and second connecting rods 12, 13 is connected with the auxiliary rod 14 respectively. Or it could be said, the two ends of the first connecting rod 12 is connected with the operating handle 11 and the auxiliary rod 14 respectively, and the two ends of the second connecting rod 13 is connected with the operating handle 11 and the auxiliary rod 14 respectively. Specifically, the first and second connecting rods 12, 13 are rotatably connected with the auxiliary rod 14 around the second axis 102, so that the operating handle 11 is capable of rotating relative to the housing assembly 20. As shown in FIG. 3, in the folded state, the user can grip the auxiliary rod 14 and the operating handle 11 with his two hands to carry the snow thrower 100. As shown in FIG. 4, the auxiliary rod 14 includes a lateral rod portion 141 and two longitudinal rod portions 142. The two longitudinal rod portions 142 are disposed on the two ends of the lateral rod portion 141. The first and second connecting rods 12, 13 are connected with the two longitudinal rod portions 142 respectively. The auxiliary rod 14 can be a hollow tube. The lateral rod portion 141 can be gripped by the user.

Figure 5:
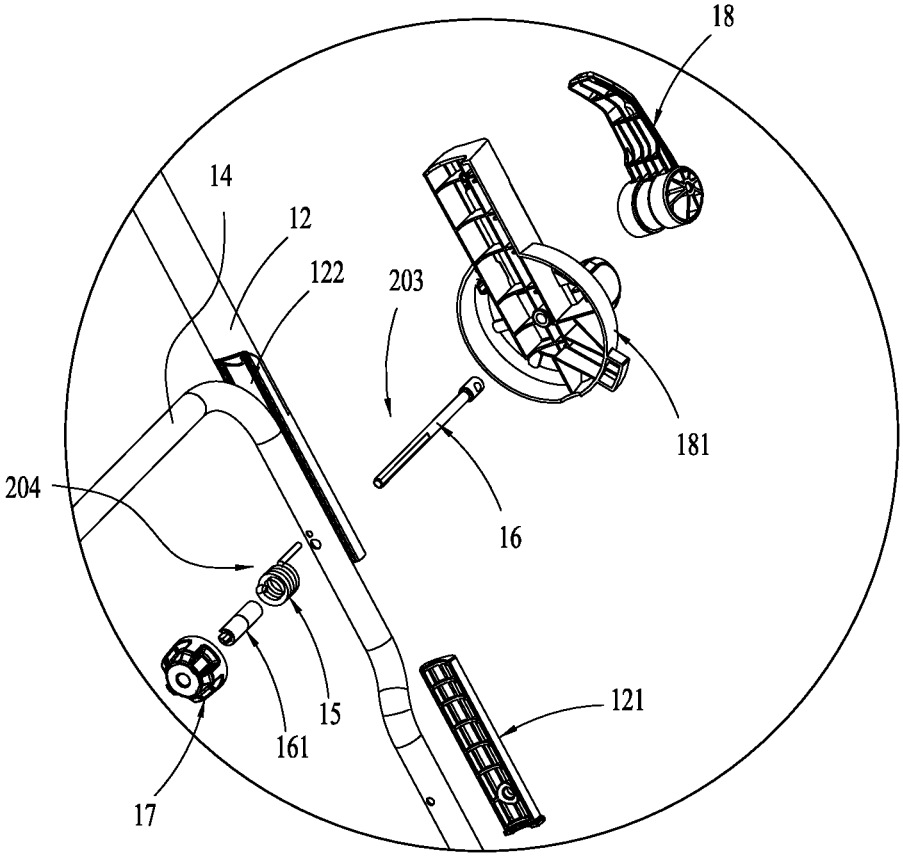
FIG. 5 is a partial enlarged view of a handle device of the snow thrower in FIG. 1.

Referring to FIGS. 4-5, the snow thrower 100 includes a rotating device 203 and a damping device 204. The rotating device 203 is configured to rotatably connect the handle device 10 with the frame 400. The damping device 204 is configured to damp the relative rotation between the handle device 10 and the frame 400. Specifically, the damping device 204 includes an elastic element 15 which embodies as a torsion spring. The elastic element 15 can generate force acting on the handle device 10 for preventing the handle device 10 from rotating in a direction relative to the frame 400. Further, the elastic element 15 can generate force acting on the first connecting rod 12 for preventing the connecting rod 12 from rotating in a direction relative to the auxiliary rod 14.

The rotating device 203 includes a connecting pin 16 for connecting the handle device 10 and the frame 400. The rotating device 203 further includes a knob 17 and a turning handle 18. The two ends of the connecting pin 16 are connected with the knob 17 and the turning handle 18 respectively. The connecting pin 16 passes through the first connecting rod 12 and the auxiliary rod 14. The turning handle 18 is rotatably connected with one end of the connecting pin 16, and the knob is rotatably connected with the other end of the connecting pin 16. The turning handle 18 has a rotation axis substantially perpendicular to a rotation axis of the knob 17.

The snow thrower 100 includes a connecting seat 181. The turning handle 18 is capable of turning relative to the connecting seat 181. In other examples, the connecting seat 181 can be omitted. As shown in FIG. 5, in this example, the connecting pin 16 passes through the auxiliary rod 14, the first connecting rod 12 and the connecting seat 181 in turn. The connecting seat 181 is located between the turning handle 18 and the first connecting rod 12. The knob 17, the auxiliary rod 14, the first connecting rod 12, the connecting seat 181 and the turning handle 18 are arranged in turn. The connecting pin 16 is covered by a pin bush 161 which rotates together with the connecting pin 16. The connecting pin 16 passes through the first connecting rod 12, the auxiliary rod 14 and the pin bush 161 in turn. When the first connecting rod 12 is rotated relative to the auxiliary rod 14, the elastic element 15 generates force acting between the first connecting rod 12 and the auxiliary rod 14, so that it can avoid the operating handle 11 dropping suddenly and damaging the operating handle 11 or the housing assembly 20 when it is needed to rotate the operating handle 11. Specifically, the connecting pin 16 passes through the torsion spring. The two ends of the torsion spring are fixed relative to the first connecting rod 12 and the auxiliary rod 14.

The connecting pin 16 is rotated with the auxiliary rod 14 or the first connecting rod 12 synchronously. That is to say, the connecting pin 16 can be fixed relative to the auxiliary rod 14 or the first connecting rod 12. Specifically, the connecting pin 16 is fixed relative to the first connecting rod 12 and rotates with the first connecting rod 12 synchronously. One end of the elastic element 15 is fixedly connected with the auxiliary rod 14, and the other end of the elastic element 15 is fixedly connected with the connecting pin 16. Alternatively, the connecting pin 16 can be fixedly connected with the auxiliary rod 14 and rotates with the auxiliary rod 14 synchronously.

As a specific example, one end of the torsion spring is inserted in the auxiliary rod 14, and the other end of the torsion spring is inserted in the pin bush 161. When the snow thrower 100 is folded, the first connecting rod 12 is rotated and drives the connecting pin 16 to rotate and, the connecting pin 16 drives the pin bush 161 to rotate. The second connecting rod 13 can be connected with the auxiliary rod 14 in the same way. The turning handle 18 is provided with a cam. When the turning handle 18 is turned so as to make the cam abut the connecting seat 181, the handle device 10 is locked relative to the auxiliary rod 14. Whereas, when the turning handle 18 is turned so as to make the cam not abut the connecting seat 181, the handle device 10 is released relative to the auxiliary rod 14. At this moment, the user can rotate the operating handle 11 relative to the housing assembly 20.

It will be appreciated that the handle device 10 and its damping method can be applied to other hand push power tools except the snow thrower 100, for example, a lawn mower.

In other examples, the damping device may include a magnetic element which may be a magnet or an electromagnet. The magnetic element generates force acting on the handle device so as to stop the frame rotating in a direction.

In other examples, the damping device may include a friction element. When the handle device is rotated toward the frame, the friction force of the friction element increases so as to stop the frame rotating in a direction and slow down the rotational speed of the handle device.

In other examples, the damping device may include an eccentric structure. When the handle device is rotated toward the frame, the eccentric structure generates force acting on the handle device so as to stop the frame rotating in a direction.

At the joint of the first connecting rod 12 and the auxiliary rod 14, the first connecting rod 12 is formed with a groove 122. The auxiliary rod 14 is partially inserted in the groove 122, so that the stability of the connection between the handle device 10 and the auxiliary rod 14 is improved. Thus, the stability between the operating handle 11 and the housing assembly 20 can be ensured when the snow thrower 100 is in the snow throwing state. An insert 121 is fixedly mounted on one end of the first connecting rod 12 and at least partially located within the first connecting rod 12. The first connecting rod 12 includes a tube opening at its one end at which the groove 122 is formed. The insert 121 is inserted in the tube opening. Or it could be said, the insert 121 is extended in the first connecting rod 12 from the tube opening. The insert 121 can increase the strength of the first connecting rod 12.

As shown in FIG. 1, the snow thrower 100 includes a switch box 19. The two ends of the switch box 19 are fixedly connected with the first connecting rod 12 and the second connecting rod 13 respectively. A trigger 191 for starting the snow thrower 100 is rotatably connected with the switch box 19 around a rotation axis substantially parallel to the first, second and third axis 101, 102, 103. A speed regulation switch 192 is rotatably connected with the switch box 19 around a rotation axis substantially parallel to the first, second and third axis 101, 102, 103. The speed regulation switch 192 is used to control speed, for example, the speed of the motor 50 or the speed of wheels 70. The speed regulation switch 192 is disposed on one end of the switch box 19 and close to the first connecting rod 12. It could also be considered as the speed regulation switch 192 being fixedly connected with the first connecting rod 12 through the switch box 19. Alternatively, the speed regulation switch 192 can be disposed close to the second connecting rod 13.

Figure 6:
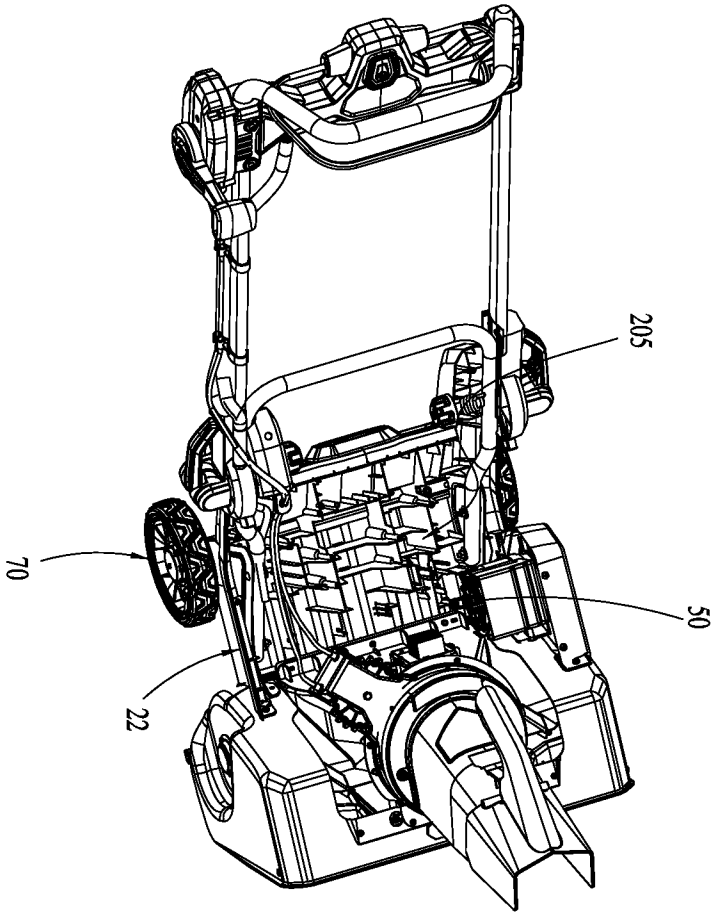
FIG. 6 is a schematic view showing a containing space of the snow thrower in FIG. 1, wherein some parts is removed.

As shown in FIG. 4, the housing assembly 20 includes a main housing 21 and a deck 22. The snow thrower 100 includes a cover 25 and a battery box 26 which can be considered as a part of the housing assembly 20. Referring to FIGS. 4 and 6, the housing assembly 20 is formed with a containing space 205 for at least partially containing a part of the motor 50. It is to be understood that the battery pack 300 is disposed within the containing space 205.

Figure 8:
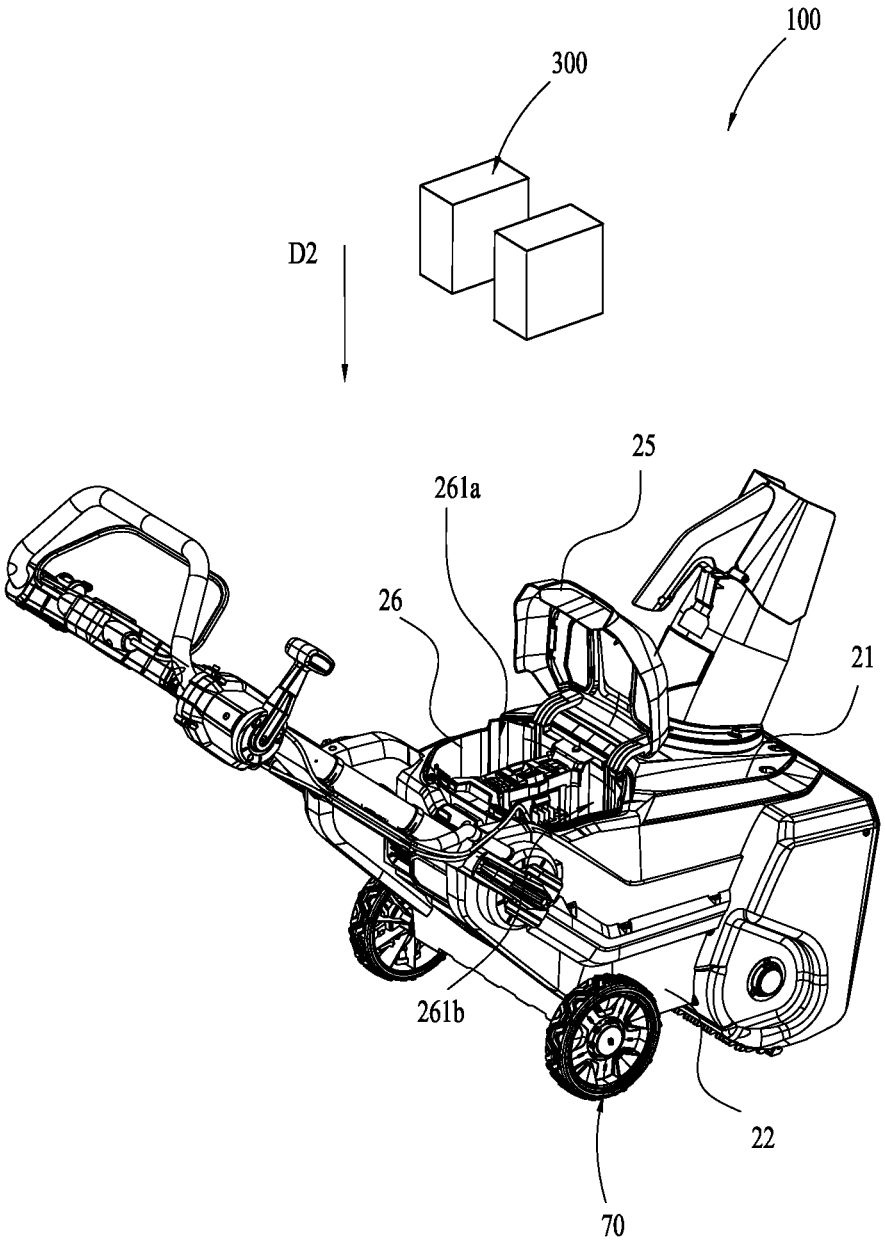
FIG. 8 is a schematic view showing the mounting of battery packs of the snow thrower in FIG. 1.

Referring to FIGS. 2-4, the main housing 21 has an upper surface which is tilted relative to the ground so as to facilitate the snow slide down. Referring to FIGS. 4 and 8, the cover 25 for covering the battery box 26 is capable of rotating relative to the main housing 21 and the deck 22. The battery box 26 is configured to contain the battery pack 300.

Referring to FIGS. 1 and 4, the auger housing 201 includes a first housing 24 and a second housing 23. The first housing 24 for mounting the auger 30 is adjacent to the second housing 23 and can cover a part of the second housing 23. Specifically, the first housing 24 is made of metal material, such as stainless steel and aluminum. The second housing 23 is made of plastic material. The first housing 24 is formed with the snow inlet 202 and, the second housing 23 is formed with the snow outlet 231. The chute device 40 is configured to guide the snow threw from the auger housing 201 by the auger 30. The snow outlet 231 makes the channel 206 to communicate with the chute device 40.

Figure 7:
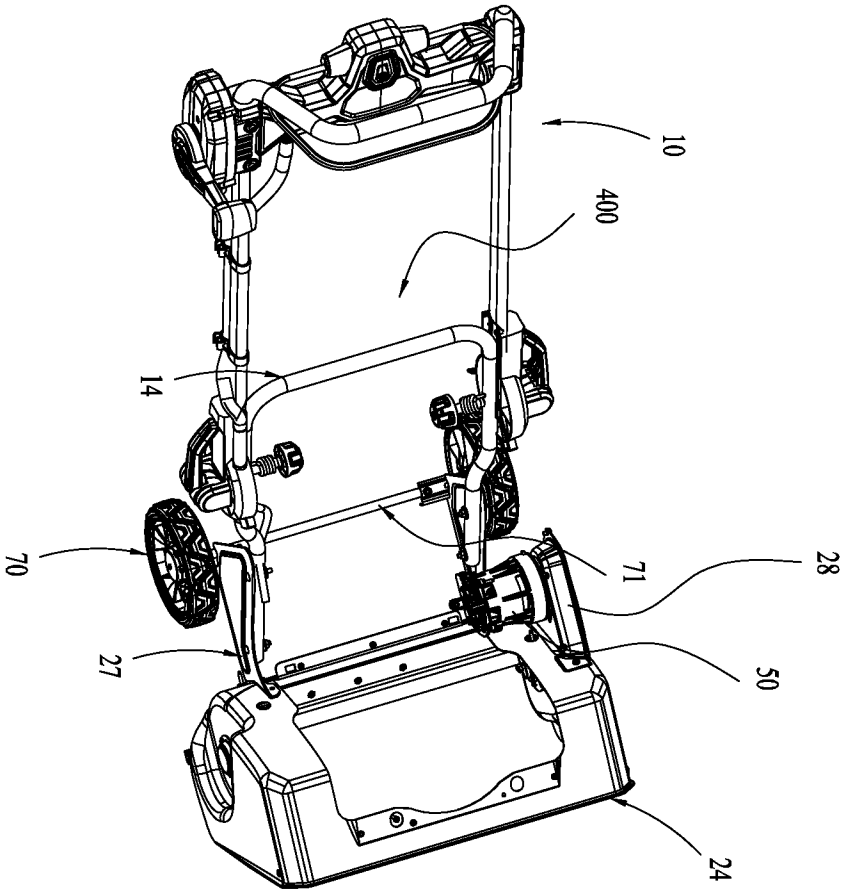
FIG. 7 is a schematic view of a frame of the snow thrower in FIG. 1.

Referring to FIGS. 6-7, the snow thrower 100 includes two wheels 70 disposed on the left and right side thereof. Specifically, the two wheels 70 are respectively mounted on two ends of a shaft 71 and capable of rotating relative to the shaft 71.

The frame 400 includes two connecting plates 27 which are made of metal material. The shaft 71, the first housing 24 and the auxiliary rod 14 are fixedly connected with the connecting plates 27. The two connecting plates 27 are fixedly mounted on the two sides of the first housing 24 respectively. The auxiliary rod 14 connects the handle device 10 and the connecting plates 27. The two connecting plates 27 are also fixedly mounted on the two sides of the auxiliary rod 14 respectively. The auxiliary rod 14 has a U shape. The auxiliary rod 14, the connecting plates 27, the shaft 71 and the first housing 24 are all made of metal material, which constitute a supporting frame of the snow thrower 100. So, the overall strength of the snow thrower 100 is improved. Specifically, the shaft 71 is disposed below the battery pack 300 and can support the battery pack 300.

The snow thrower 100 can adopt one or more battery packs 300. As shown in FIG. 8, the snow thrower 100 includes two battery packs 300. The motor 50 can be powered by either or both of the two battery packs 300. The snow thrower 100 may include a controller. When the snow thrower 100 is started, the controller is capable of identifying the number of the battery packs 300 coupled with a coupling portion of the snow thrower 100 automatically and, then controlling one or two battery packs 300 to power the motor 50. Further, the controller is capable of controlling the two battery packs 300 to supply electric energy to the motor 50 in turn or at the same time. The two battery packs 300 are detachably coupled to the battery box 26. Specifically, the two battery packs 300 are disposed symmetrically. The battery box 26 is formed with two chambers 261*a*, 261*b*. The two battery packs 300 can be inserted into the two chambers 261*a*, 261*b* along a second direction D2. The second direction D2 is substantially perpendicular to the first axis 101 of the wheels 70. The battery packs 300 have a voltage which is greater than or equal to 36V and less than or equal to 120V. Further, the voltage of the battery packs 300 is greater than or equal to 36V and less than or equal to 80V, in particular, greater than or equal to 48V and less than or equal to 80V.

The coupling portion for coupling the battery packs 300 includes two power input terminals 262 located in the two chambers 261*a*, 261*b* respectively. The battery packs 300 are provided with power output terminals for engaging with the power input terminals 262. When the battery packs 300 are inserted in the chambers 261*a*, 261*b* along the second direction D2, the power output terminals are coupled with the power input terminals 262 so that the battery packs 300 can output electric energy to the motor 50. The battery box 26 is provided with multi battery sockets constituted by the power input terminals 262. Each battery socket can couple with one battery pack 300. When the voltage of the battery packs 300 coupled with the battery sockets is lower than a predetermined value, the discharging is stopped.

The cover 25 is capable of rotating between an open position and a closed position. As shown in FIG. 8, when the cover 25 is in the open position, the two battery packs 300 are exposed, so that the user can take out the battery packs 300 from the battery box 26 conveniently. As shown in FIG. 1, the cover 25 is in the closed position and covers the battery packs 300.

Figure 9:
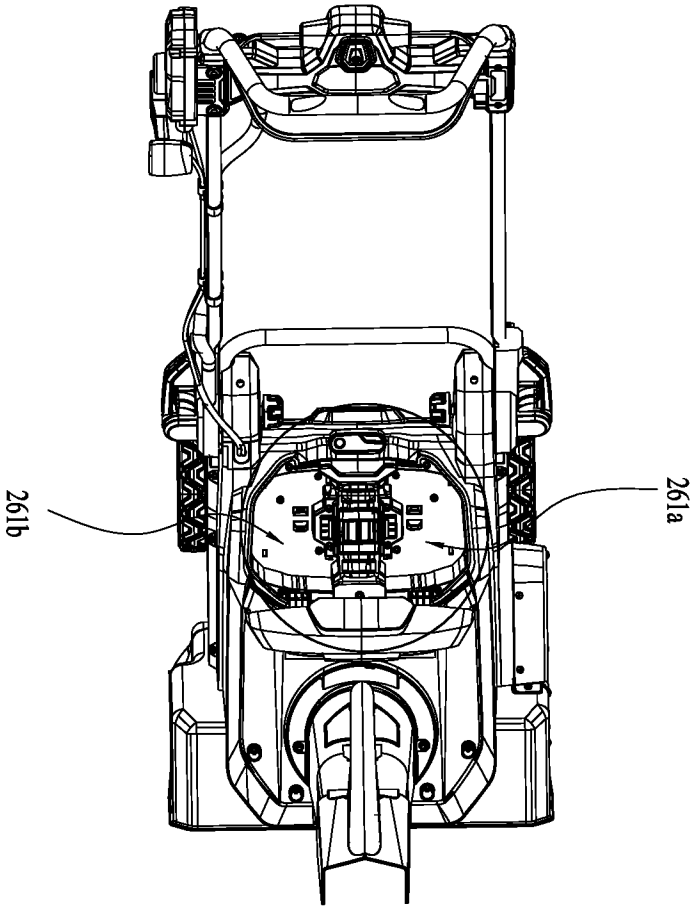
FIG. 9 is a top view of the snow thrower in FIG. 8, wherein the battery packs are removed.
Figure 10:
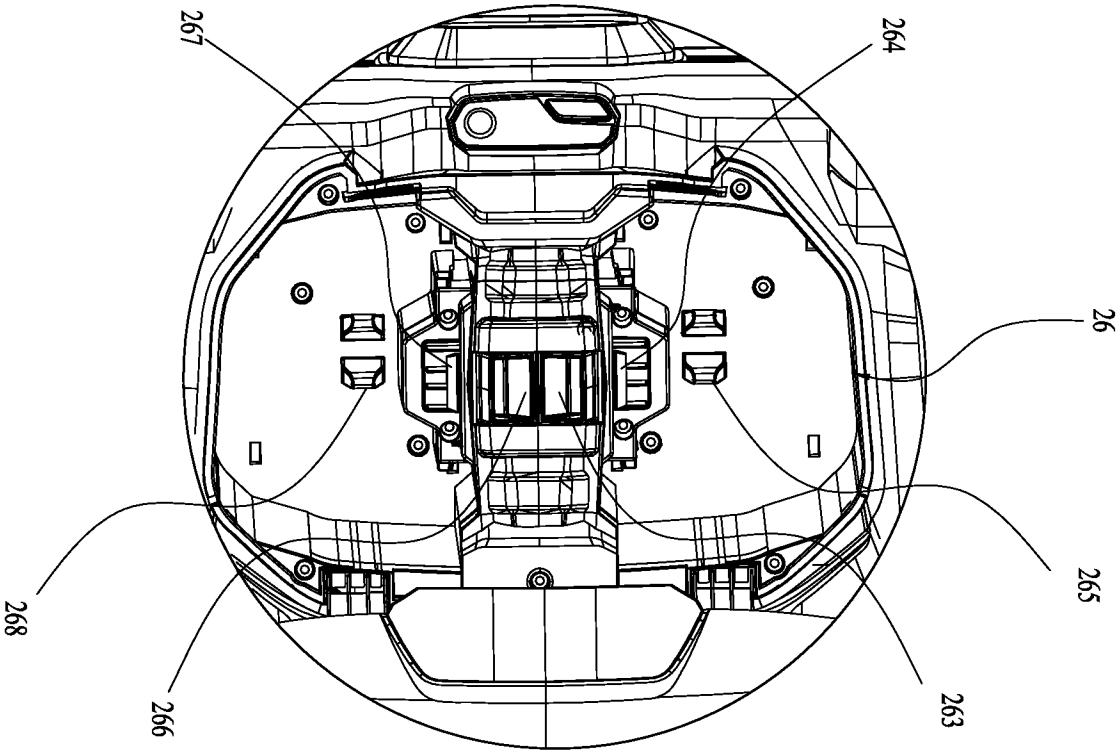
FIG. 10 is a partial enlarged view of the snow thrower in FIG. 9.

Referring to FIGS. 8-10, the snow thrower 100 includes a first release button 263, a second release button 266, a first locking element 264, a second locking element 267, a first pop-up element 265 and a second pop-up element 268. When the battery packs 300 are inserted in the chambers 261*a*, 261*b*, the first locking element 264 and the second locking element 267 are capable of locking the battery packs 300 relative to the battery box 26. When the user presses or rotates the first release button 263 and the second release button 266, the lock of the battery packs 300 relative to the battery box 26 is released. Under the action of the first pop-up element 265 and the second pop-up element 268, the two battery packs 300 move upward, so that the user can take the battery packs 300 out. Specifically, the first release button 263 and the second release button 266 are located between the two battery packs 300. In other examples, the first release button 263 and the second release button 266 can be integrated as a whole release button. When the user presses the whole release button, the two battery packs 300 are released at the same time and move upward.

Figure 11:
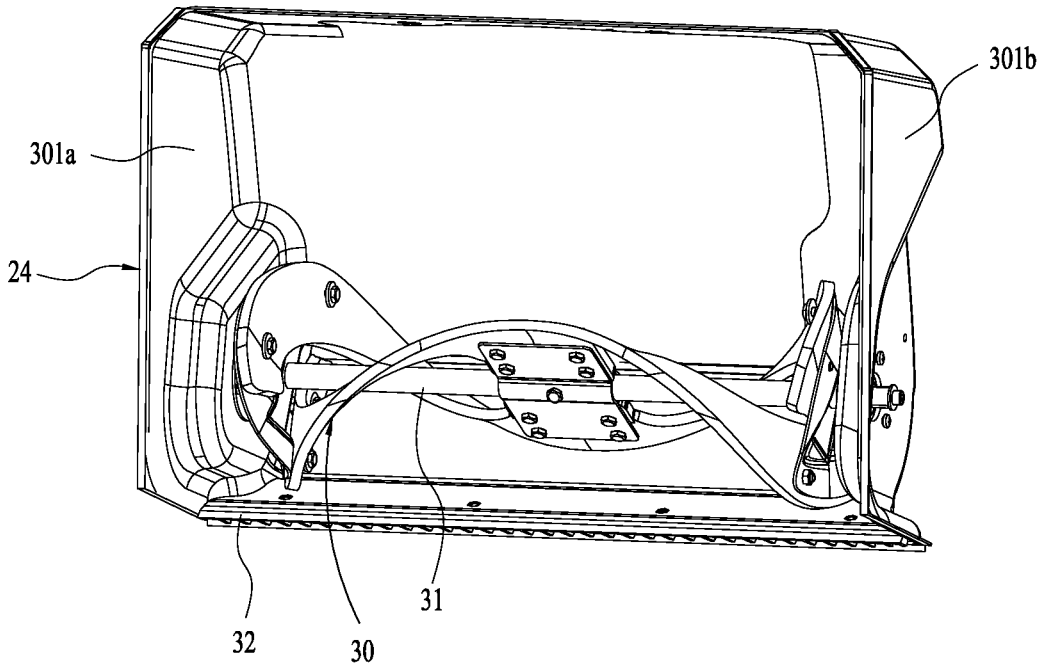
FIG. 11 is a schematic view of an auger of the snow thrower in FIG. 1.
Figure 12:
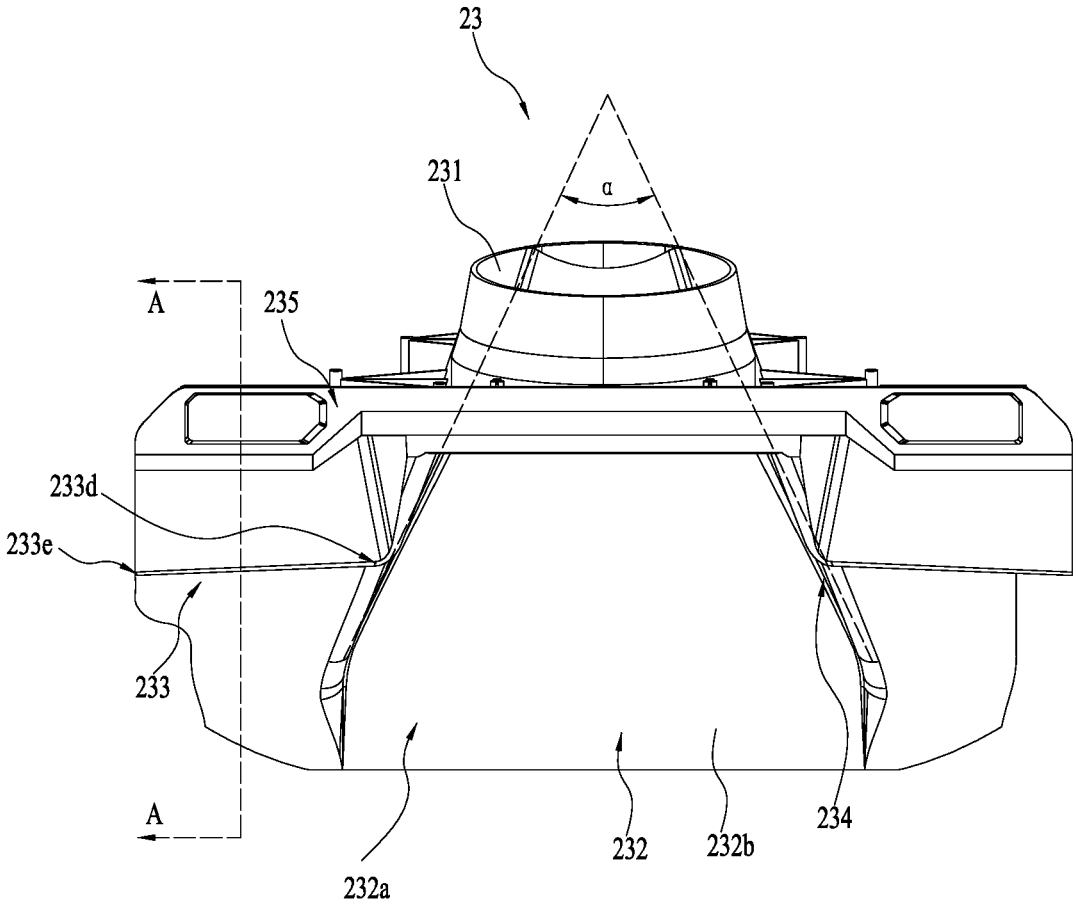
FIG. 12 is a schematic view of a second housing of the snow thrower in FIG. 1.
Figure 13:
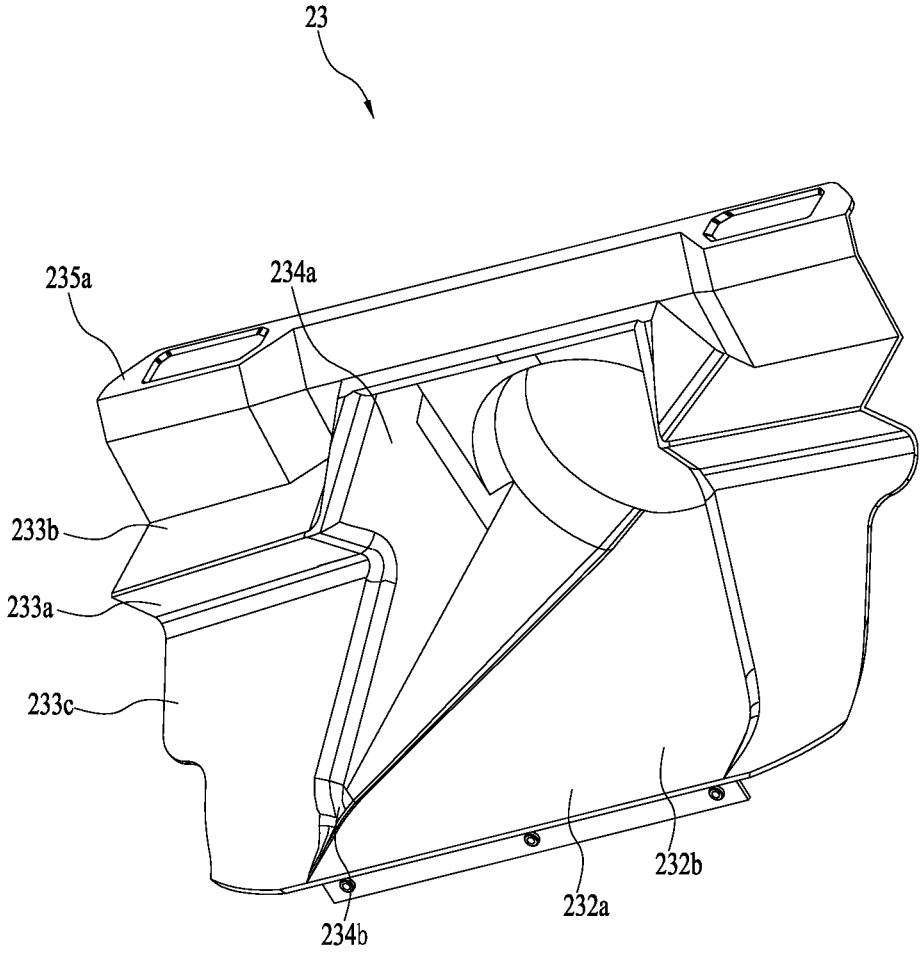
FIG. 13 is a schematic view of the second housing of the snow thrower in FIG. 1 in another perspective.
Figure 14:
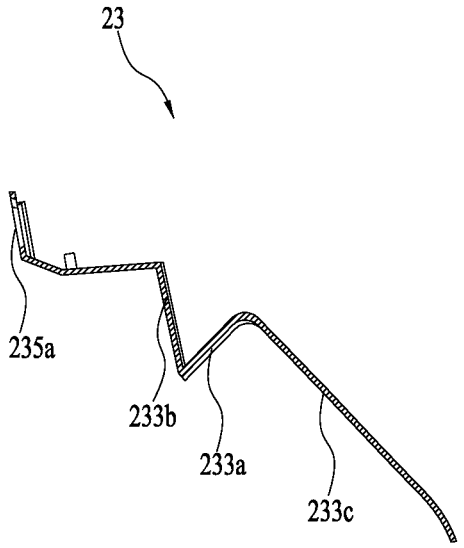
FIG. 14 is a cross section of the second housing cut along A-A.

As shown in FIG. 11, the auger 30 for removing snow is mounted on the first housing 24 through a drive shaft 31. The first housing 24 includes two side walls 301*a*, 301*b* disposed oppositely. The auger 30 is rotatably disposed between the two side walls 301*a*, 301*b*. The two ends of the drive shaft 31 are supported by the two side walls 301*a*, 301*b*.

When the auger 30 is rotated around a rotation axis of the drive shaft 31, it can realize the function of snow removing. In a direction of the drive shaft 31, the auger 30 includes a scraping section and a throwing section. The drive shaft 31 is mounted on the two side walls of the first housing 24. A scraping strip 32 is mounted on the bottom of the first housing 24. When it is needed to assemble the auger 30, the drive shaft 31 goes into from one side of the first housing 24 and passes through the auger 30 and, then goes out from the other side of the first housing 24. The auger 30 includes two scraping sections disposed approximately on its two ends. The throwing section is located in the middle portion of the auger 30. The two scraping sections are disposed on the two ends of the throwing section and extended out from the throwing section. The scraping sections have a spiral shape, so that they can transfer a part of the scraped snow to the throwing section and then throw out the snow through the throwing section.

Referring to FIGS. 1, 4 and 12-14, the channel 206 has a channel wall. The channel wall includes a back plate portion 232, a baffle plate portion 233 and a side plate portion 234 which are formed by the second housing 23. The second housing 23 is configured to guide the snow scraped by the auger 30 to the chute device 40. Specifically, the back plate portion 232 guides the snow scraped by the auger 30 to the chute device 40. The baffle plate portion 233 is configured to stop the auger 30 close to the snow scraped on the two ends of the auger 30 so as to block the snow on the two ends of the auger 30 back to the auger 30. Then the auger 30 guides the snow to the throwing section and, further then the snow is thrown to the back plate portion 232. The second housing 23 is configured to guide the snow in the auger housing 201 to the snow outlet 231.

The side plate portion 234 is used to connect the back plate portion 232 and the baffle plate portion 233. For the second housing 23, it can include two side plate portions 234 which are respectively disposed on the left and right sides of the back plate portion 232.

Specifically, the back plate portion 232 includes a back plate 232*a* disposed on one side of the auger 30. The back plate 232*a* is provided with a guiding plane 232*b* substantially parallel to the rotation axis of the auger 30. So the back plate 232*a* can guide the snow to the snow outlet 231 uniformly. The back plate 232*a* has a shape of isosceles trapezoid approximately. The isosceles trapezoid has two hypotenuses which extended and intersect to form a fixed angle α. The back plate 232*a* can guide the snow scraped by the auger 30 into the fixed angle α and, then to the chute device 40. The fixed angle α is greater than or equal to 20 degrees and less than or equal to 60 degrees. Thus, the back plate 232*a* can guide the snow from a large lateral width area to a small lateral width area, so as to throw the snow intensively.

The back plate 232*a* has a first maximum size along a direction parallel to the first axis 101 and a second maximum size along a direction parallel to the rotation axis of the auger 30. A ratio between the first and second maximum sizes is greater than or equal to 0.6 and less than or equal to 0.75. With this arrangement, while the back plate 232*a* can guide most snow in the longitudinal direction of the auger 30, the back plate 232*a* has a reasonable size in a direction perpendicular to the first axis 101 under the limit of the fixed angle α. So the overall height of the snow thrower 100 is reduced.

Otherwise, an angle between the guiding plane 232*b* of the back plate 232*a* and the ground is greater than or equal to 70 degrees and less than or equal to 90 degrees. An angle between the guiding plane 232*b* of the back plate 232*a* and a plane going through the first axis 101 and the drive shaft 31 is greater than or equal to 65 degrees and less than or equal to 90 degrees.

With this arrangement, when the snow thrower 100 is in the snow throwing state, the back plate 232*a* is inclined, so that the power of snow is increased. It is noted that, the angle between the guiding plane 232*b* and the ground refers to the snow thrower 100 in the snow throwing state as shown in FIG. 2.

The side plate portion 234 includes a side plate 234*a* extending in a direction perpendicular to the guiding plane 232*b* of the back plate 232*a*. In a direction which is perpendicular to the first axis 101 and parallel to the back plate 232*a*, the two side plates 234*a* on the two sides of the back plate 232*a* are close to each other from the snow inlet 202 to the snow outlet 231 so as to limit the angle of snow entering to the fixed angle α.

The side plate 234*a* is provided with a block edge 234*b* with a certain length at its end close to the auger which is substantially perpendicular to the drive shaft 31. As we know, during the rotation of the auger 30, the auger 30 forms a virtual cylinder at its extreme edge which surrounds the auger 30 and, the snow is thrown along a direction of a tangent plane of the virtual cylinder and in a preset angle with a certain angel to the direction of the tangent plane. At this moment, because the block edge 234*b* stretches across the preset angle, the quantity of snow blocked by the block edge 234*b* is increased. Further, the block edge 234*b* is inclined toward the back plate 232*a*, so that it can guide the snow to the back plate 232*a*. Thus, the effect of snow throwing is improved.

The baffle plate portion 233 includes a reflecting plate 233*a*, an upper baffle plate 233*b* and a lower baffle plate 233*c*. The reflecting plate 233*a* is configured to reflect the snow to the auger 30. Specifically, the reflecting plate 233*a* can reflect at least a part of the snow scraped close to the two ends of the auger 30 to the middle portion of the auger 30. The upper and lower baffle plates 233*b*, 233*c* are disposed on the opposite sides of the reflecting plate 233*a*.

The baffle plate portion 233 includes two reflecting plates 233*a* which are disposed above the scraping sections of the auger 30 correspondingly and respectively. The reflecting plates 233*a* are inclined relative to the drive shaft 31. In detail, the reflecting plate 233*a* has an inner edge 233*d* close to the side plate 234*a* and an outer edge 233*e* far from the side plate 234*a*. The inner and outer edges 233*d*, 233*e* are disposed oppositely. When the snow thrower 100 is in the snow throwing state, in a direction parallel to the ground, the inner edge 233*d* is higher than the outer edge 233*e*. An angle between a plane in which the reflecting plate 233*a* is located and an extending direction of the drive shaft 31 is greater than or equal to 1 degree and less than or equal to 5 degrees. Thus, when the snow scraped by the two ends of the auger 30 is thrown to the reflecting plate 233*a*, the reflecting plate 233*a* can reflect the snow to the middle portion of the auger 30 and, then the snow is thrown to the back plate 232*a* through the throwing section. So the snow is prevented from reflecting out of the second housing 23 so as to affect the effect of snow throwing. Otherwise, an angle between the plane in which the reflecting plate 233*a* is located and a plane in which the lower baffle plate 233*c* is located is greater than or equal to 50 degrees and less than or equal to 90 degrees, so that the effect of snow throwing is improved.

The upper and lower baffle plates 233*b*, 233*c* are configured to reflect at least a part of the snow thrown by the auger 30 toward the front of the snow thrower 100. An angle between an extending direction of the first connecting rod 12 and a plane in which the upper baffle plate 233*b* is located is greater than or equal to 80 degrees and less than or equal to 100 degrees. An angle between the extending direction of the first connecting rod 12 and the plane in which the lower baffle plate 233*c* is located is also greater than or equal to 80 degrees and less than or equal to 100 degrees. Thus, when the snow thrower 100 is in the snow throwing state, the upper and lower baffle plates 233*b*, 233*c* can reflect a part of the snow thrown by the auger 30 toward the front of the snow thrower 100 and reflect a part of the snow to the auger 30. So the effect of snow throwing is further improved.

Otherwise, the upper baffle plate 233*b* is provided with a mounting portion 235 extending therefrom. The mounting portion 235 includes a mounting plate 235*a* for mounting a lighting device 80. A plane in which the mounting plate 235*a* is located is substantially parallel to the first axis 101 of the wheels 70. An angle between the extending direction of the first connecting rod 12 and the plane in which the mounting plate 235*a* is located is greater than or equal to 45-60 degrees. So, the lighting device 80 is disposed on the top of the channel 206 and, can cast light toward the front of the snow thrower 100.

Figure 15:
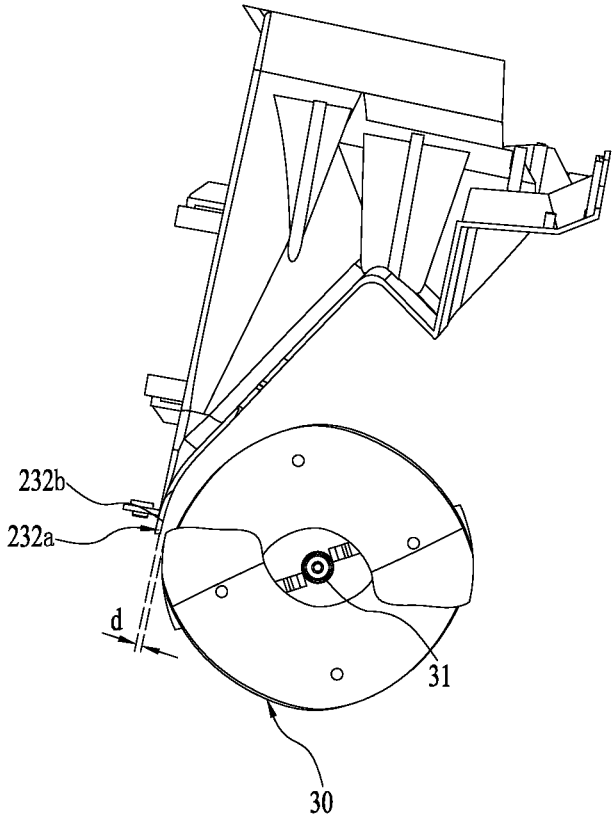
FIG. 15 is a schematic view of the auger along a direction of a driving shaft.

As shown in FIG. 15, a distance d between an edge of a projection of the auger 30 on a plane perpendicular to the drive shaft 31 or perpendicular to the rotation axis of the auger 30 and the guiding plane 232*b* of the back plate 232*a* is greater than or equal to 1 mm and less than or equal to 5 mm, so the distance between the auger 30 and the back plate 232*a* can be reduced as much as possible. Thus, the speed of snow throwing and a distance between the snow and the back plate 232*a* is improved and, the effect of snow throwing is further improved. Otherwise, the auger 30 can include two scraping blades. A projection of one of the two scraping blades on the plane perpendicular to the drive shaft 31 has an edge which at least includes a segment of circular arc.

The segment of circular arc is symmetrical relative to the drive shaft 31. Actually, under an ideal state, it is hoped that the edge of the projection of the auger 30 on the plane perpendicular to the drive shaft 31 is a circular. So a distance from any point on the edge of the auger 30 to the drive shaft 31 is equivalent and, the uniformity of snow scraping is improved and the effect of snow throwing is further improved.

Figure 16:
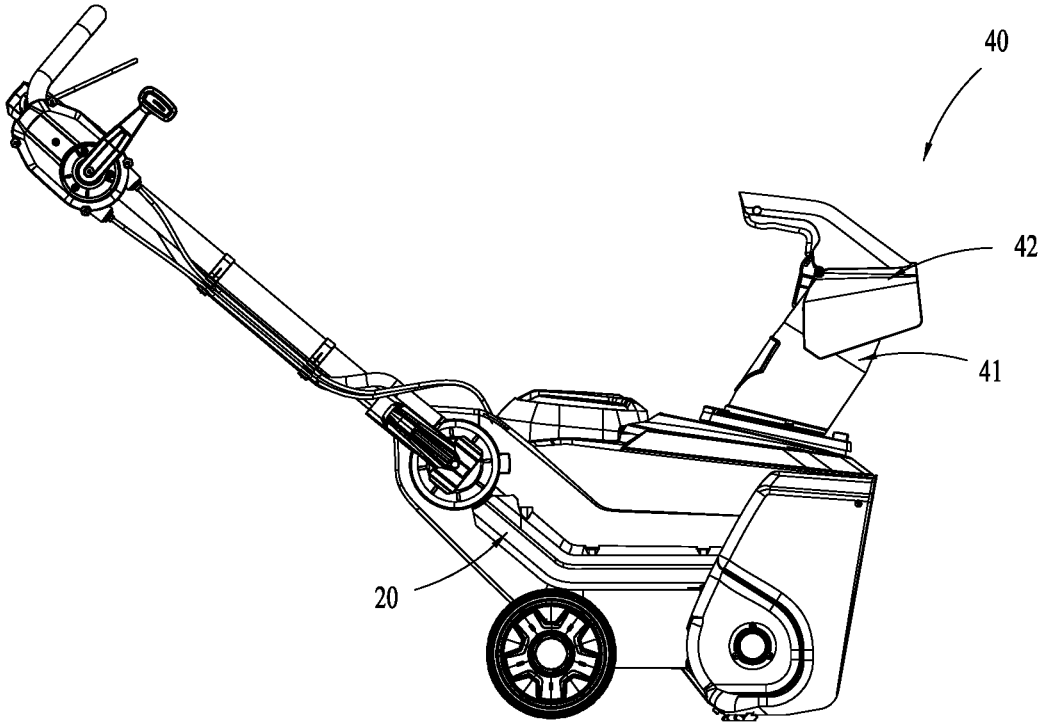
FIG. 16 is a schematic view of a chute device after a deflector is rotated.

Referring to FIGS. 2 and 16, the chute device 40 mainly includes a chute 41 and a deflector 42. The chute 41 is rotatably connected with the housing assembly 20. Specifically, when it is needed to assemble the chute 41, the chute 41 is inserted in the housing assembly 20 from front to back. The chute 41 can be rotated around a fifth axis 105 relative to the housing assembly 20 so as to adjust the throwing angle of the chute 41. The fifth axis 105 is substantially perpendicular to the first axis 101. The deflector 42 is disposed on one end of the chute 41 which is far from the housing assembly 20 and can be pivoted relative to the chute 41 so as to adjust the throwing height and throwing distance of snow. The deflector 42 is at a position relative to the chute 41 in FIG. 2 and, the deflector 42 is pivoted to another position relative to the chute 41 in FIG. 16.

Referring to FIGS. 1 and 17-21, in order to realize the rotation of the chute device 40 relative to the housing assembly 20, the snow thrower 100 includes the angle adjusting device 60. The angle adjusting device 60 includes an adjusting handle 61 for the user to operate. The adjusting handle 61 is capable of driving the chute device 40 to rotate relative to the housing assembly 20 through a driving assembly when it is operated. The adjusting handle 61 is rotatably connected with the operating handle 11 around a forth axis 104 substantially parallel to the first, second and third axis 101, 102, 103. The forth axis 104 is also substantially parallel to the rotation axis of the speed regulation switch 192 and the rotation axis of the trigger 191. The forth axis 104 is substantially perpendicular to the fifth axis 105. Thus, when the user rotates the adjusting handle 61 around the forth axis 104, the chute device 40 can be rotated relative to the housing assembly 20 so as to adjust the throwing angle of snow.

For the operating handle 11, the adjusting handle 61 is rotatably mounted on the handle device 10 through a handle housing 62 and, in particular on the second connecting rod 13 far from the speed regulation switch 192. That is to say, the speed regulation switch 192 and the adjusting handle 61 are mounted on the two sides of the operating handle 11 respectively. In the direction parallel to the first axis 101, the speed regulation switch 192 is mounted on one end of the operating handle 11 and, the adjusting handle 61 is mounted on the other end of the operating handle 11. For the middle plane S1 of the operating handle 11, the speed regulation switch 192 and the adjusting handle 61 are disposed on the two sides of the middle plane S1 respectively. The speed regulation switch 192 and the adjusting handle 61 are disposed on the first connecting rod 12 and the second connecting rod 13 respectively. For the user, when the snow thrower 100 is operated, he can operate the speed regulation switch 192 with one hand, and operate the adjusting handle 61 with the other hand.

For operating conveniently, a ratio between a first maximum rotation angle of the adjusting handle 61 relative to the operating handle 11 and a second maximum rotation angle of the chute device 40 relative to the housing assembly 20 or the frame 400 is greater than or equal to 0.25 and less than or equal to 1.5. Further, the ratio can be less than or equal to 1. Thus, the chute device 40 can be rotated a large angle while the user is only needed to rotate the adjusting handle 61 a small angle. So the operation of angle adjusting is convenient.

As an example, in an extending direction of the second connecting rod 13, a ratio between a distance from the adjusting handle 61 to the operating handle 11 and an overall length of the second connecting rod 13 is greater than or equal to 0.1 and less than or equal to 0.5. Or, in the extending direction of the second connecting rod 13, the distance between the adjusting handle 61 and the operating handle 11 is greater than or equal to 30 mm and less than or equal to 500 mm. Further, the distance is greater than or equal to 50 mm and less than or equal to 200 mm. Thus, while the user grips the operating handle 11 with one hand, he can rotate the adjusting handle 61 with the other hand easily and conveniently.

More specifically, the handle housing 62 is fixedly mounted on the handle device 10 through the switch box 19. The handle housing 62 includes a left housing 621 and a right housing 622 which can be departed from each other. The left housing 621 and the right housing 622 encompass a containing chamber.

A rotating wheel 63 is disposed within the containing chamber formed by the left housing 621 and the right housing 622. When the adjusting handle 61 is rotated around the forth axis 104, it drives the rotating wheel 63 to rotate.

The rotating wheel 63 is formed with a first winding groove 631 and a second winding groove 632. The first winding groove 631 is used to wind an end of a first connecting wire 65 and, the second winding groove 632 is used to wind an end of a second connecting wire 66. The first and second winding grooves 631, 632 are formed at different axial positions of the rotating wheel 63. The ends of the first and second winding grooves 631, 632 wound on the rotating wheel 63 are detachably fastened in the rotating wheel 63 through a pin respectively.

A tension spring 68 generates force to tension the first and second connecting wire 65, 66. Specifically, the tension spring 68 has two ends connected with a first tension element 681 and a second tension element 682 respectively. The first tension element 681 contacts with the first connecting wire 65 and, the second tension element 682 contacts with the second connecting wire 66. The first and second tension elements 681, 682 are close to each other under the action of the tension spring 68 so as to drive the first and second connecting wires 65, 66 to bend and close to each other. Thereby, the first and second connecting wires 65, 66 are tensioned.

The handle housing 62 is formed with a sliding rail 623. The first and second tension elements 681, 682 slide in the sliding rail 623. Specifically, the sliding rail 623 is formed by the left housing 621. The right housing 622 is located between the left housing 621 and the adjusting handle 61.

Figure 20:
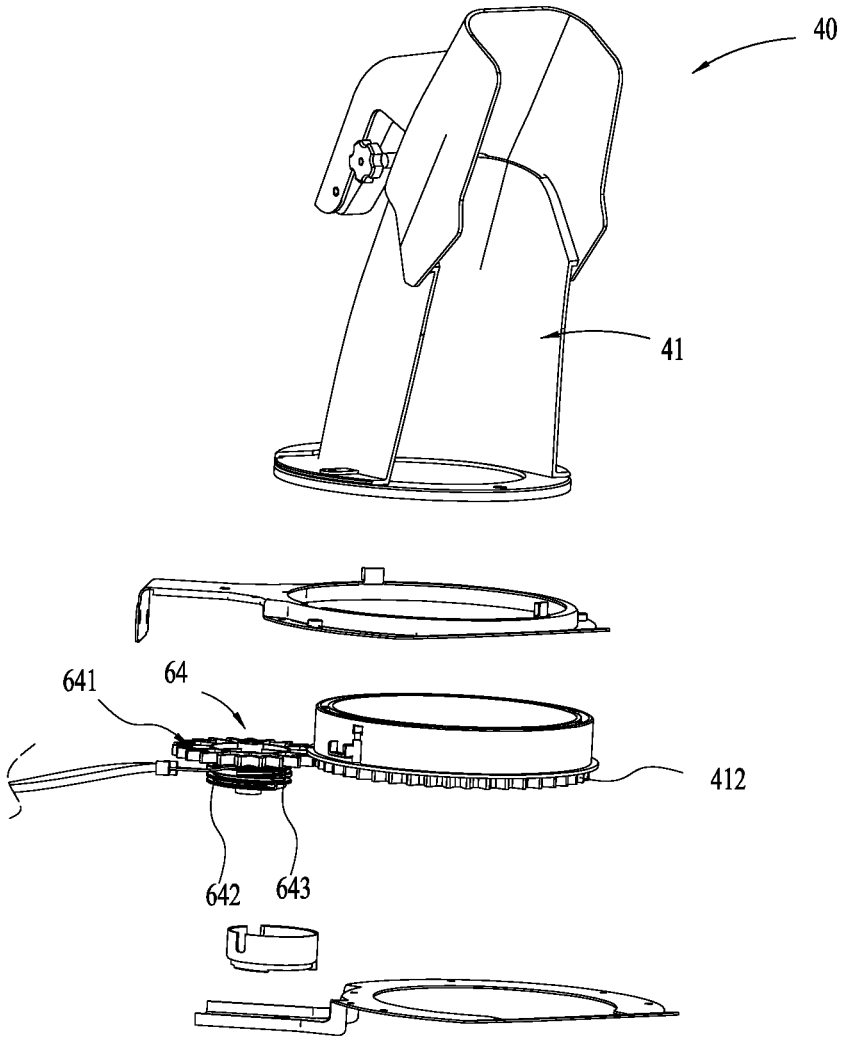
FIG. 20 is an exploded view of other parts of the angle adjusting device and the chute device.
Figure 21:
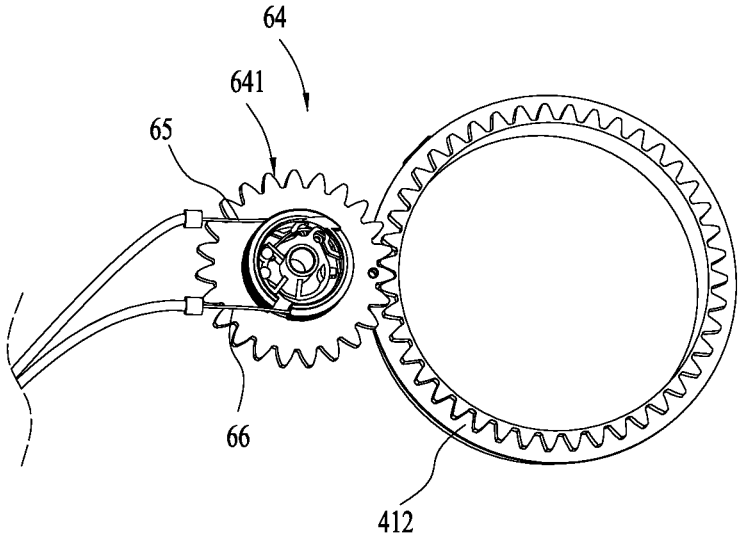
FIG. 21 is a schematic view of a part of the structures in FIG. 20.
Figure 22:
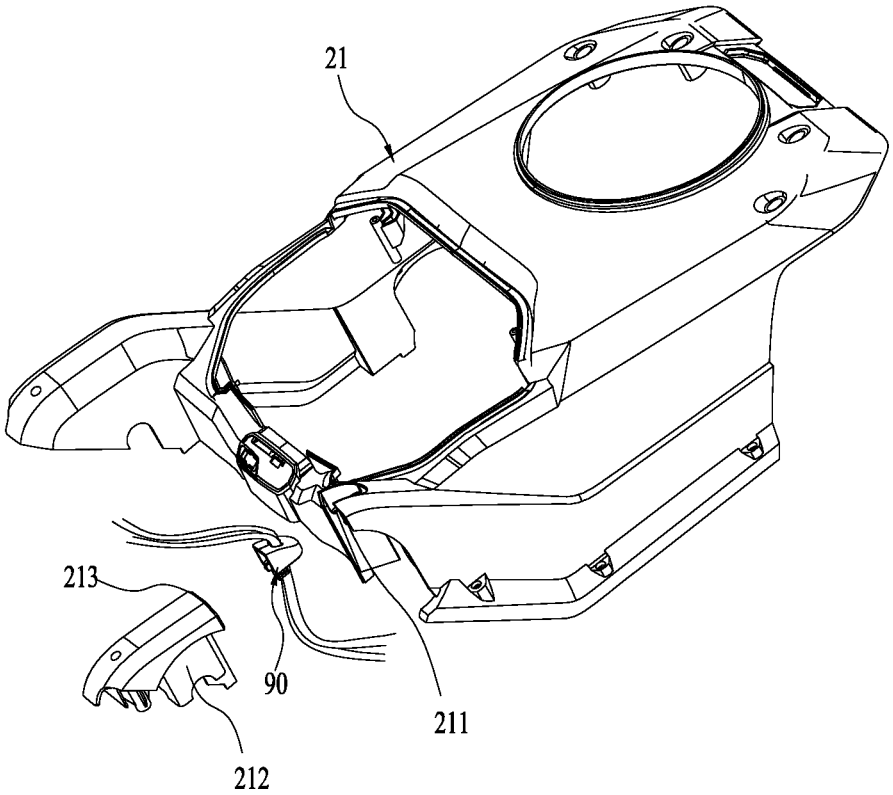
FIG. 22 is an exploded view of a main housing, an auxiliary housing and an inserting block in FIG. 1.
Figure 23:
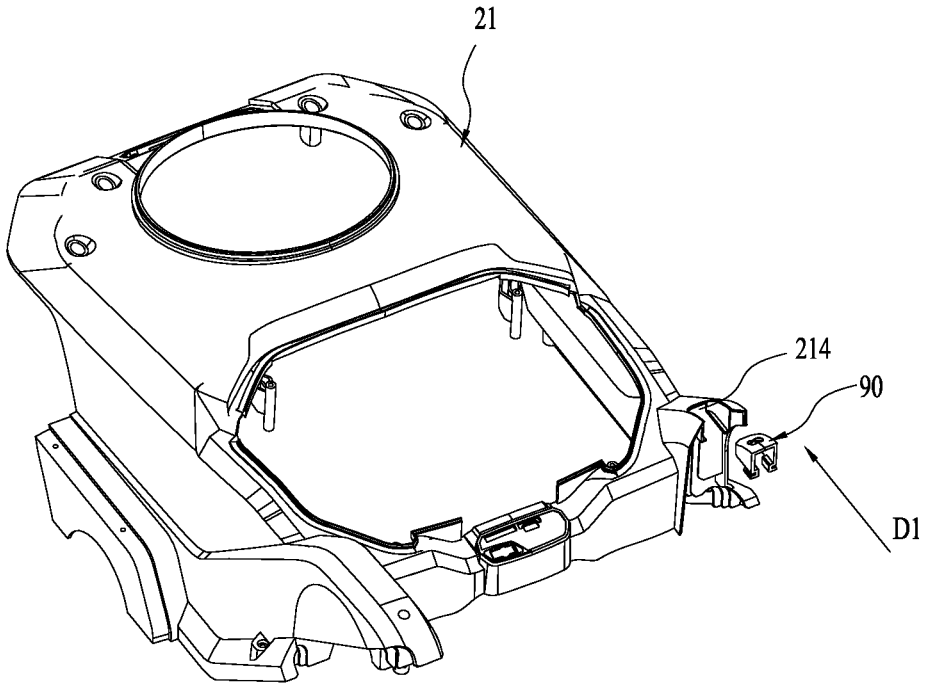
FIG. 23 is a schematic view showing the mounting of the inserting block in FIG. 22.
Figure 24:
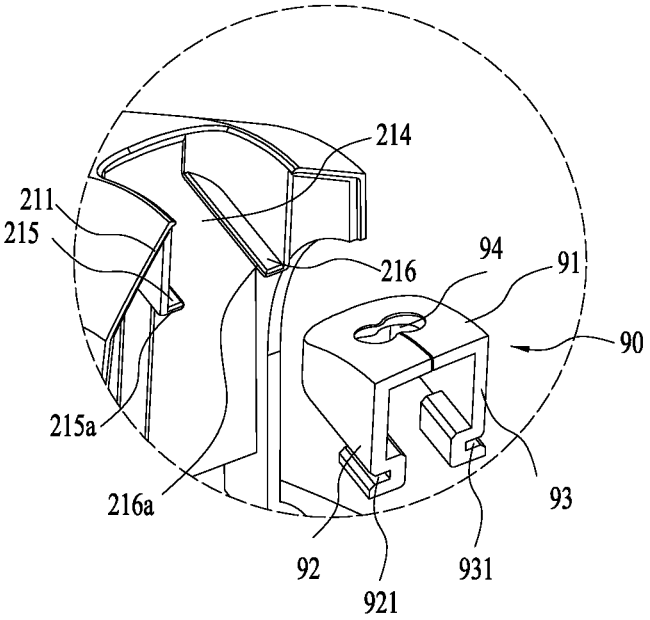
FIG. 24 is a partial enlarged view of the structures in FIG. 23.

Referring to FIGS. 20-21, a driving wheel 64 is arranged within the housing assembly 20. The driving wheel 64 includes a driving portion 641, a third winding groove 642 and a forth winding groove 643 which are formed at different axial positions thereof. The driving portion 641 is a gear formed on the driving wheel 64. The chute device 40 includes an outer gear ring 412 for engaging with the driving portion 641. Or it could be said, the outer gear ring 412 is formed by the chute device 40. Specifically, the outer gear ring 412 is fixed to the chute 41. A transmission ratio between the driving portion 641 and the outer gear ring 412 is greater than or equal to 1 and less than or equal to 2. In other examples, the outer gear ring 412 can be formed by the chute 41 directly. The third winding groove 642 is used to wind the other end of the first connecting wire 65 and, the forth winding groove 643 is used to wind the other end of the second connecting wire 66. The ends of the first and second connecting wires 65, 66 wound on the driving wheel 64 are detachably fastened in the driving wheel 64 through a pin. The first and second connecting wires 65, 66 are extended between the rotating wheel 63 and the driving wheel 64. The rotation of the rotating wheel 63 is transferred to the driving wheel 64 through the first and second connecting wires 65, 66. The rotation axis of the chute device 40 or the chute 41 is substantially parallel to a rotation axis of the driving wheel 64.

When the adjusting handle 61 is rotated along a first rotation direction, it drives the rotating wheel 63 to rotate so as to tension the first connecting wire 65. The first connecting wire 65 tends to wind on the first winding groove 631 of the rotating wheel 63, while a part of the second connecting wire 66 is released from the second winding groove 632 of the rotating wheel 63. The first connecting wire 65 drives the driving wheel 64 to rotate and, the driving wheel 64 drives the chute device 40 to rotate along a direction.

When the adjusting handle 61 is rotated along a second rotation direction which is opposite to the first rotation direction, it drives the rotating wheel 63 to rotate in an opposite direction so as to tension the second connecting wire 66. The second connecting wire 66 tends to wind on the second winding groove 632 of the rotating wheel 63, while a part of the first connecting wire 65 is released from the first winding groove 631 of the rotating wheel 63. The second connecting wire 66 drives the driving wheel 64 to rotate and, the driving wheel 64 drives the chute device 40 to rotate along an opposite direction.

It could be understood that, the adjusting handle 61 is rotated along a direction so as to drive the chute device 40 to rotate along a direction; while when the adjusting handle 61 is rotated along an opposite direction, the chute device 40 is rotated along an opposite direction.

Otherwise, in order to increase the ratio between the first maximum rotation angle of the adjusting handle 61 relative to the handle device 10 and the second maximum rotation angle of the chute device 40 relative to the housing assembly 20, the angle adjusting device 60 further includes an active wheel 67 which connects the rotating wheel 63 and the adjusting handle 61. The rotating wheel 63 is provided with engaging teeth for engaging with the active wheel 67. The active wheel 67 has engaging teeth, the number of which is greater than the number of the engaging teeth of the rotating wheel 63. The adjusting handle 61 is fixedly connected with the active wheel 67 and rotated with the active wheel 67 synchronously. The active wheel 67 drives the rotating wheel 63 to rotate. A transmission ratio between the rotating wheel 63 and the active wheel 67 is greater than or equal to 0.25 and less than or equal to 1. The active wheel 67 has the same rotation axis as the adjusting handle 61. The rotation axis of the active wheel 67 and the adjusting handle 61 is substantially parallel to the rotation axis of the rotating wheel 63.

In order to fix the position of the adjusting handle 61 relative to the handle housing 62, the angle adjusting device 60 further includes a limiting block 672 for limiting gears of the adjusting handle 61. The active wheel 67 is provided with a plurality of locating recesses 671 for engaging with the limiting block 672 selectively. The plurality of locating recesses 671 can be formed by the active wheel 67. The limiting block 672 is connected with the handle housing 62. A spring is arranged between the limiting block 672 and the handle housing 62. Specifically, the limiting block 672 is connected with the left housing 621 and, the spring is arranged between the limiting block 672 and the left housing 621.

Referring to FIGS. 1, 4, 17 and 22-24, the power tool includes connecting lines. A part of the connecting lines is located on one side of the main housing 21 and, the other part of the connecting lines is located on the other side of the main housing 21. It also could be said, the connecting lines pass through the main housing 21. The connecting lines can be cables or metal wires. Specifically, the first and second connecting wires 65, 66 are connecting lines. It could be understood, the first connecting wire 65 and a jacket surrounding the first connecting wire 65 act as a connecting line and, the second connecting wire 66 and a jacket surrounding the second connecting wire 66 act as another connecting line. The first and second connecting wires 65, 66 pass through the main housing 21. One end of the first and second connecting wires 65, 66 is extended into the housing assembly 20.

After the snow thrower 100 is used for a long time, it is commonly needed to open the housing assembly 20 to examine or repair the components in the housing assembly 20. In order to facilitate to disassemble some components, the snow thrower 100 includes an inserting block 90 allowing the first and second connecting wires 65, 66 to pass through the main housing 21 from outside and extend into the housing assembly 20. The housing assembly 20 includes an auxiliary housing 212. When the auxiliary housing 212 is coupled with the main housing 21, they constitute a whole. The inserting block 90 is arranged between the main housing 21 and the auxiliary housing 212.

Figure 17:
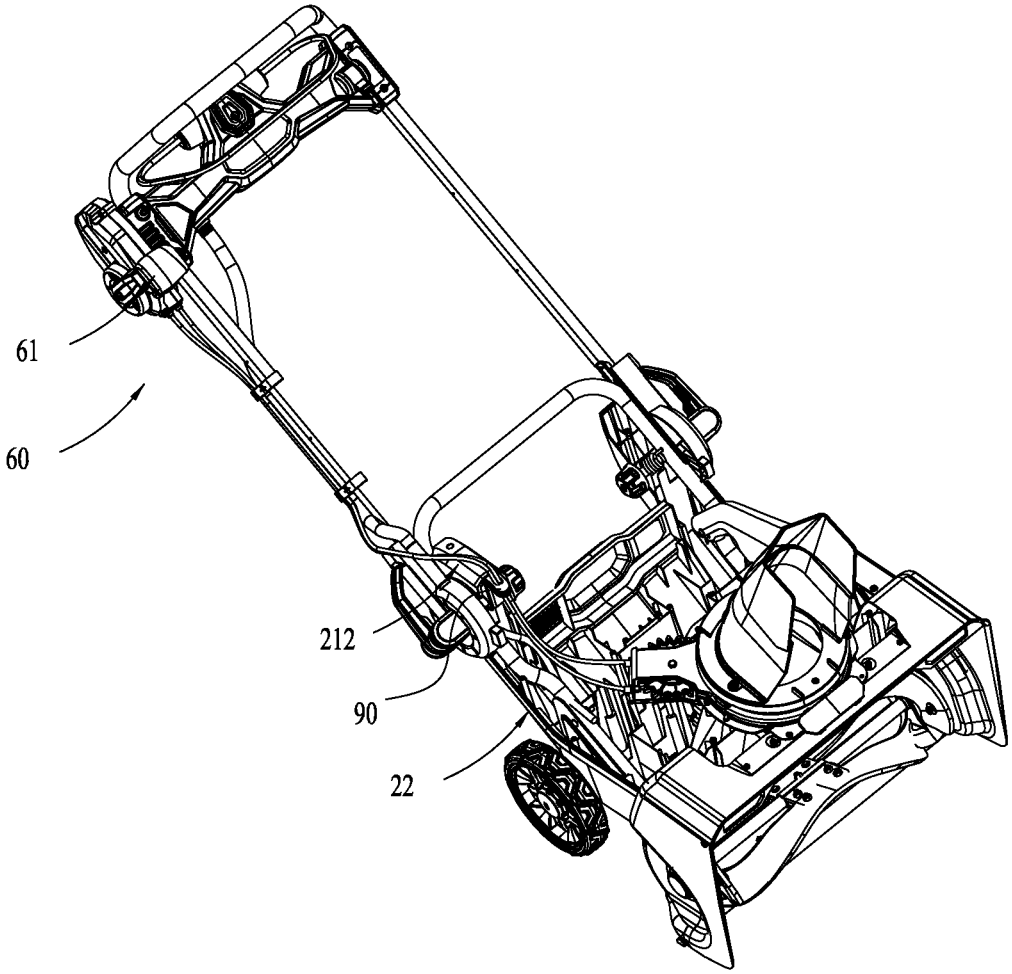
FIG. 17 is a schematic view of the structure in FIG. 6 in another perspective.
Figure 18:
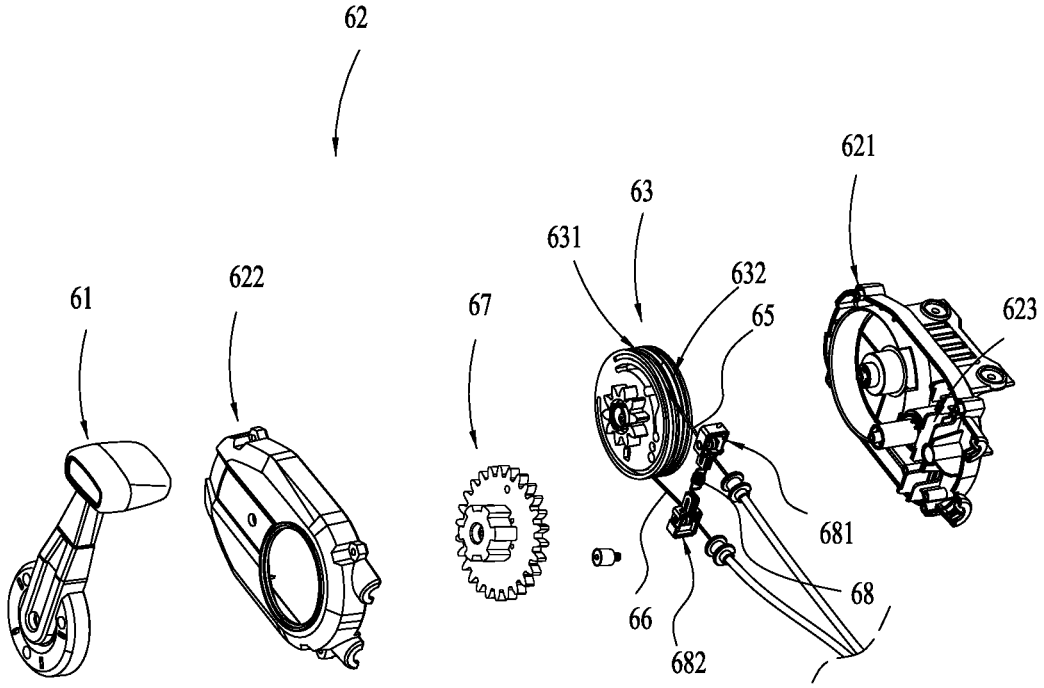
FIG. 18 is an exploded view of a part of an angle adjusting device.
Figure 19:
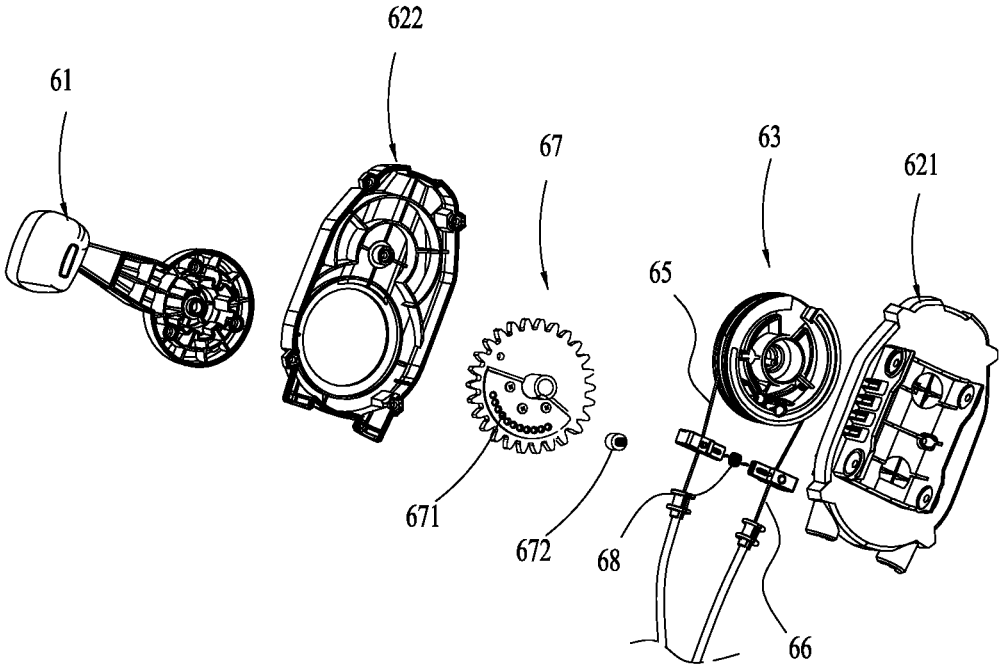
FIG. 19 is a schematic view of the structure in FIG. 18 in another perspective.

The main housing 21 can be detached from the housing assembly 20. Or it could be said, the main housing 21 is detachable relative to the auxiliary housing 212 and, also detachable relative to the deck 22. Further, the main housing 21 is detachable relative to a whole constituted by the auxiliary housing 212 and the deck 22. The main housing 21 is detachable relative to other parts of the housing assembly 20 except itself. As shown in FIG. 17, the main housing 21 is removed from the snow thrower 100 and, in this state, the maintenance operation can be taken place effectively.

The main housing 21 includes an end face 211. A slot 214 is formed on the end face 211. The inserting block 90 is engaged with the slot 214 and detachably coupled with the slot 214 along a first direction D1. The inserting block 90 is symmetrically arranged relative to a plane parallel to the first direction D1. For the entire main housing 21, the inserting block 90 is arranged between the main housing 21 and the auxiliary housing 212. In detail, the auxiliary housing 212 includes an auxiliary end face 213 being capable of engaging with the end face 211 of the main housing 21. When the end face 211 of the main housing 21 is engaged with the auxiliary end face 213 of the auxiliary housing 212, the inserting block 90 is limited between the main housing 21 and the auxiliary housing 212.

Specifically, the slot 214 includes two opposite slot walls. The two opposite slot walls are formed with a first guiding portion 215 and a second guiding portion 216 respectively. The first guiding portion 215 is extended from one slot wall toward the main housing 21 and, the second guiding portion 215 is extended from the other slot wall toward the main housing 21. The first and second guiding portions 215, 216 respectively include a first hook 215*a* and a second hook 216*a* which tend to close to each other. The first guiding portion 215 has a L shaped cross section cut by a plane perpendicular to the first direction D1 and, a cross section of the second guiding portion 215 cut by a plane perpendicular to the first direction D1 is a mirror symmetry of the L shape.

The inserting block 90 includes a holding portion 91, a first connection portion 92 and a second connection portion 93. When the inserting block 90 is coupled with the main housing 21, the holding portion 91 covers the slot 214 partially. The holding portion 91 is provided with a through hole 94. When the inserting block 90 is coupled with the slot 214, the through hole 94 communicates with the two sides of the main housing 21. Thus, the first and second connecting wires 65, 66 can pass through one side of the main housing 21 through the through hole 94 and extend to the other side of the main housing 21. At this moment, the first and second connecting wires 65, 66 respectively include two portions located on the two sides of the main housing 21.

As an example, the inserting block 90 can be made of material which is different from the main housing 21. In order to protect the first and second connecting wires 65, 66, the inserting block 90 can be made of material which is softer than the main housing 21. Specifically, the main housing 21 can be made of plastic and, the inserting block 90 can be made of rubber.

Otherwise, in order to enable the first and second connecting wires 65, 66 to pass through the through hole 94, the through hole 94 has a cross section cut by the plane parallel to the first direction D1 which includes two circular arcs more than half. So, when the first and second connecting wires 65, 66 pass through the through hole 94, they are prevented from damage due to long time interlacing therebetween.

The first connecting portion 92 is configured to engage with the first guiding portion 215 and, the second connecting portion 93 is configured to engage with the second guiding portion 216. When the inserting block 90 is coupled with the slot 214 along the first direction D1, the first connecting portion 92 can slide relative to the first guiding portion 215 along the first direction D1 and, the second connecting portion 93 can slide relative to the second guiding portion 216 along the first direction D1. Specifically, the first and second connecting portions 92, 93 are respectively formed with connecting grooves 921, 931 allowing the first and second hooks 215*a*, 216*a* to insert, so that the inserting block 90 is capable of sliding relative to the first and second guiding portions 215, 216 along the first direction D1.

Thereby, when it is needed to open the main housing 21 to examine or repair the components in the housing assembly 20, the user only need to pull the inserting block 90 out from the slot 214 so as to make the first and second connecting wires 65, 66 disengage from the main housing 21. At this moment, the main housing 21 can be detached conveniently, and the first and second connecting wires 65, 66 can't be affected.

It could be understood that, the inserting block 90 not only can be applied to the snow thrower 100, but also applied to other power tools, as long as the power tools have a connecting line passing from one side of the housing assembly to the other side.

Referring to FIGS. 1-2, the snow thrower 100 includes a lighting device 80 for illuminating a working area in front of the snow thrower 100. The lighting device 80 defines a window 801 for the light to pass through. The lighting device 80 is configured to illuminate the working area in front of the window 801. The lighting device 80 can generate light irradiating forward from the window 801. The auger housing 201 contains the auger 30 and the lighting device 80. The window 801 is arranged in the front side of the rotation axis of the auger 30. The snow thrower 100 includes two lighting devices 80 and, each lighting device 80 defines a window 801. The two lighting devices 80 and two windows 801 are arranged on the left side and right side of the snow thrower 100 respectively. Specifically, the chute device 40 can be rotated relative to the auger housing 201. The two lighting devices 80 and two windows 801 are arranged on the two sides of a plane which passes through the fifth axis 105 of the chute device 40 and is perpendicular to the third axis of the auger 30, and symmetrical relative to the plane. The plane coincides with the middle plane S1 of the handle device 10 or the operating handle 11, or it could be considered that the two planes are the same plane. In the direction of fifth axis, the lighting devices 80 and windows 801 are located between the chute device 40 and the auger 30. When the snow thrower 100 is in the snow throwing state, in the direction perpendicular to the ground, the lighting devices 80 and windows 801 are located between the chute device 40 and the auger 30. The snow throwing state means the snow thrower 100 is moved on the ground to throw snow, as shown in FIG. 2. In FIG. 2, the up and down direction on the paper is the direction perpendicular to the ground.

Referring to FIGS. 1 and 4, the lighting devices 80 are mounted on the second housing 23 of the housing assembly 20 and located in the first housing 24. The windows 801 are arranged on one side of the second housing 23 which is far from the ground.

The chute device 40, the wheels 70, the motor 50, the battery packs 300 and the second axis 102 of the operating handle 11 are arranged between the operating handle 11 and the windows 801. The first axis of the wheels 70 is arranged between the second axis 102 of the operating handle 11 and the windows 801. The battery packs 300 are arranged between the second axis 102 of the operating handle 11 and the windows 801.

The lighting devices 80 are arranged in the front side of the chute device 40 and far from the operating handle 11. So, the light generated by the lighting devices 80 can't be blocked by the chute device 40, and a dark area can't occur, which realizes the effect of shadowless lamps. On the other hand, when the user stands at the operating handle 11 to operate, the lighting devices 80 can illuminate the area in front of the snow thrower 100 so as to increase the irradiation distance and strength of the lighting devices 80.

In order to prevent the lighting devices 80 from blocking by the snow, heating elements for thawing the snow close to the lighting devices 80 are arranged on the lighting devices 80. As another example, the motor 50 can generate high temperature during working which can pass the lighting devices 80 and thaw the snow thereon.

As shown in FIG. 7, the motor 50 is fixedly mounted on a mounting part 28. The mounting part 28 is fixedly mounted on the first housing 24. The mounting part 28 is made of metal material, and it can transfer the heat of the motor 50 to the first housing 24 so as to cool the motor 50.

Referring to FIGS. 1, 6, 25-26, the snow thrower 100 includes a circuit board for controlling the motor 50 and/or the batter packs 300. A controller is constituted by the elements on the circuit board. The circuit board is contained within the containing space 205. A cooling device is connected with the circuit board so as to cool the circuit board.

As an example, the circuit board includes a first circuit board 85 and a second circuit board 86. Here, the first and second circuit boards 85, 86 are disposed separately. The first circuit board 85 is used to control the batter packs 300. The first circuit board 85 can be fixedly disposed, for example, on one side of the second housing 23 that is far from the auger 30, also on the back of the second housing 23. The second circuit board 86 is inclined relative to the ground so as to prevent it from immersing in the water.

Figure 25:
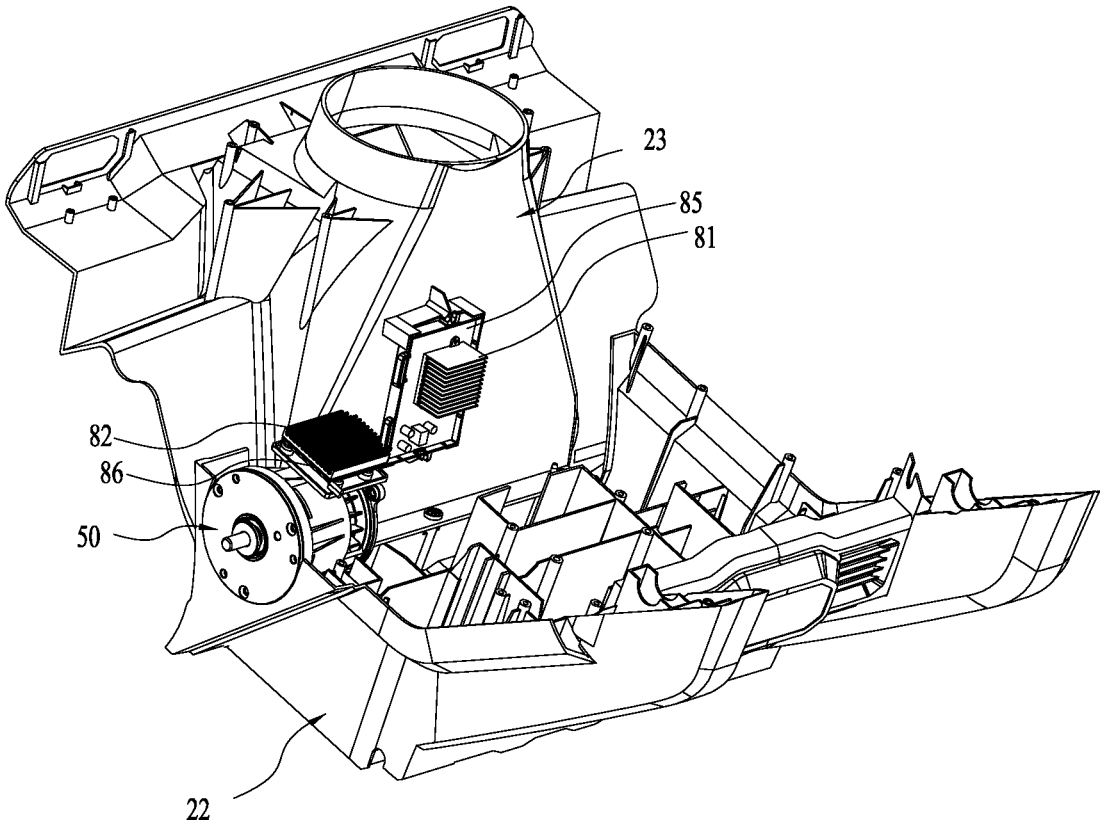
FIG. 25 is a schematic view of a deck, the second housing and a motor in FIG. 1.
Figure 26:
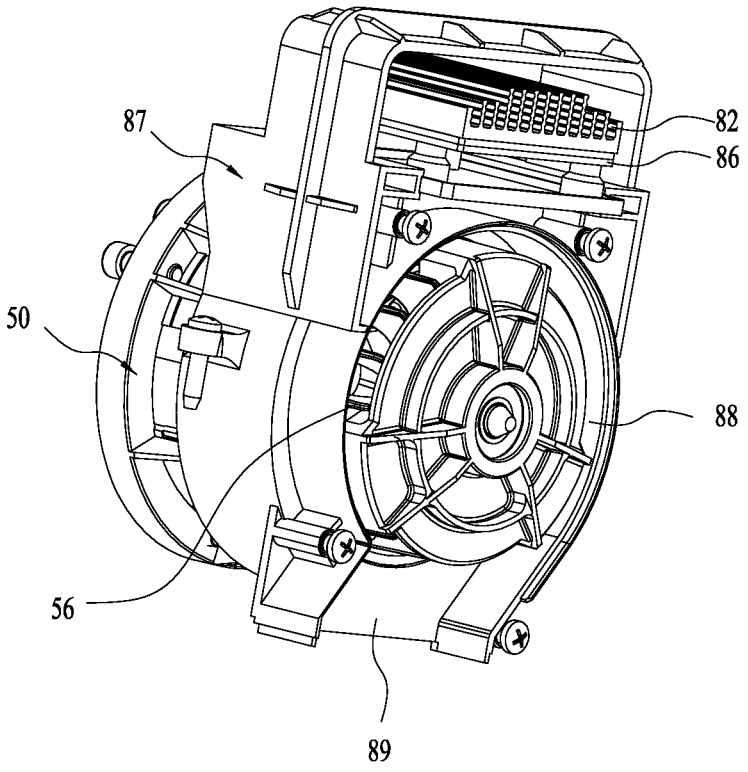
FIG. 26 is a schematic view of the motor and an air deflector in FIG. 1.
Figure 27:
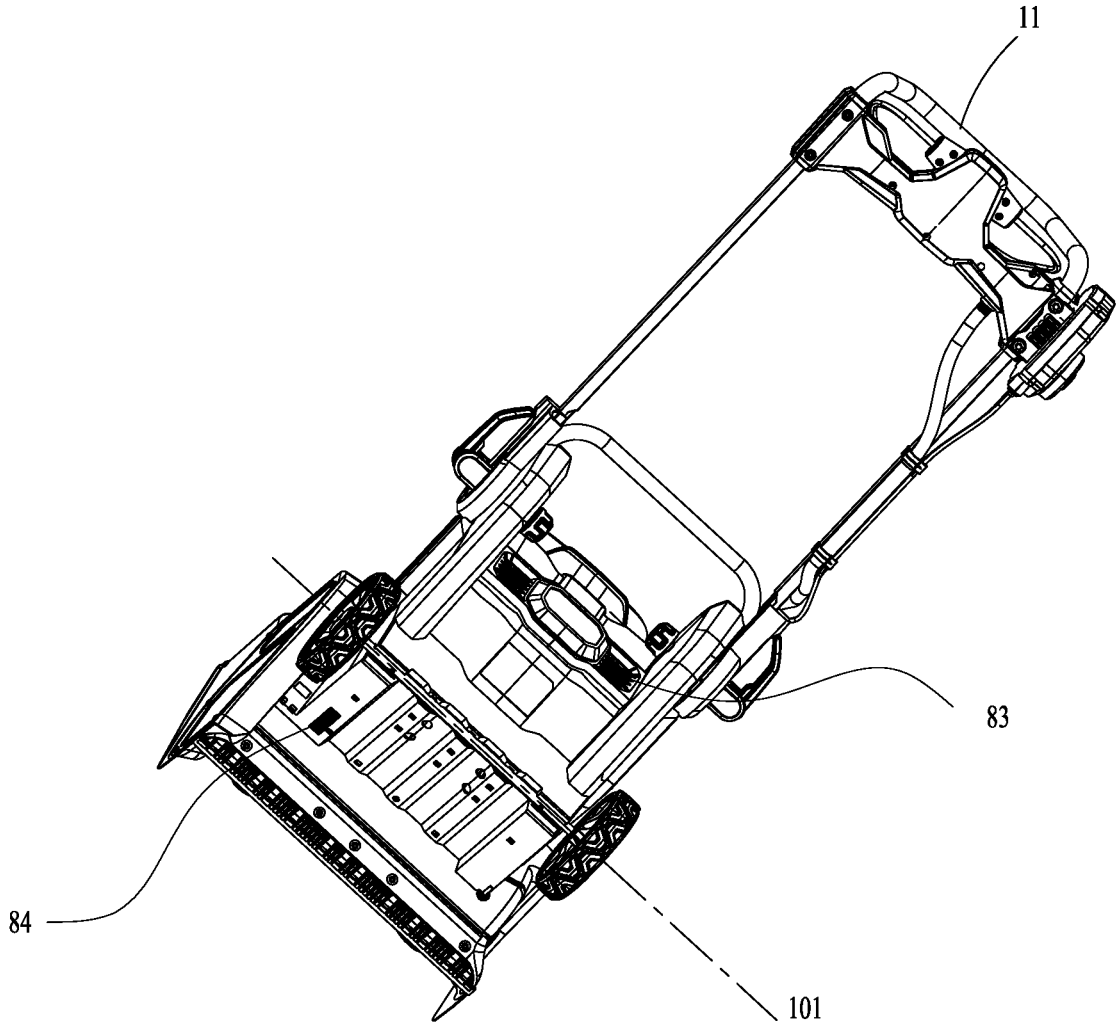
FIG. 27 is a schematic view of the snow thrower in FIG. 1 in another perspective.

The second circuit board 86 is used to control the motor 50. The second circuit board 86 can be fixedly mounted on the motor 50 through a holder. The snow thrower 100 can include a motor cover and a support. FIG. 25 shows the positional relationship of the motor 50, the deck 22 and the second housing 23, wherein the support and the motor cover are removed.

Referring to FIGS. 1, 6, 25-27, in order to cool the circuit board and other components, the housing assembly 20 is formed with an airflow inlet 83 and an airflow outlet 84. The airflow inlet and outlet 83, 84 communicate the inside and outside of the containing space 205. The cooling device includes a first cooling element 81 and a second cooling element 82 which are disposed within the containing space 205.

The motor 50 can include a fan 56. When the fan 56 is rotated, it can generate a cooling airflow which flows into the containing space 205 from the airflow inlet 83 and flows out of the containing space 205 from the airflow outlet 84. The cooling airflow at least can flow through the first circuit board 85, the first cooling element 81, the second circuit board 86 and the second cooling element 82. The first circuit board 85, the first cooling element 81, the second circuit board 86, the second cooling element 82 and the fan 56 are all arranged within the containing space 205. The cooling airflow also flows through the motor 50. When the battery packs 300 are coupled with the housing assembly 20, the cooling airflow flows through the battery packs 300 so as to cool the battery packs 300.

The first cooling element 81 is fixedly mounted on the motor 50. Correspondingly, the second circuit board 86 is fixedly mounted on the second cooling element 82. That is, the second circuit board 86 is fixedly connected with the motor 50. The airflow inlet and outlet 83, 84 are configured to communicate the inside and outside of the containing space 205 of the housing assembly 20, which are disposed at reasonable positions on the housing assembly 20. So, the airflow, which flows into the containing space 205 from the airflow inlet 83 and flows out of the containing space 205 from the airflow outlet 84, at least can flow through the first and second circuit boards 85, 86. Thus, the airflow can cool the first and second circuit boards 85, 86 at the same time. As another example, the cooling airflow can flow through the lighting device 80 so as to thaw the snow thereon.

For the entire snow thrower 100, the airflow inlet and outlet 83, 84 are disposed on the two sides of the middle plane S1 of the operating handle 11 respectively, so that the cooling airflow can flow through the middle plane S1 of the operating handle 11. And the airflow inlet and outlet 83, 84 are disposed on the two sides of a plane passing through the first axis 101 of the wheels 70 respectively and, the first axis 101 of the wheels 70 is disposed between the airflow outlet 84 and the operating handle 11 so as to increase the length of a path from the airflow inlet 83 to the airflow outlet 84 and improve the cooling effect.

As an example, when the two battery packs 300 are coupled with the housing assembly 20, the airflow inlet and outlet 83, 84 are respectively disposed on the two sides of a whole constituted by the two battery packs 300. After the cooling airflow enters into the housing assembly 20 from the airflow inlet 83, it can flow through the surrounding of the battery packs 300, and then flow through the first cooling element 81, so that the battery packs 300 are cooled.

More specifically, the airflow inlet and outlet 83, 84 are disposed on the two sides of the motor 50 respectively, so that the cooling airflow can flow through the motor 50.

More specifically, the first cooling element 81 is provided with a plurality of first ribs extending in a direction parallel to the rotation axis of the motor 50. The plurality of first ribs is capable of guiding the airflow to flow toward the motor 50 after the airflow flows through the first circuit board 85. The second cooling element 82 is provided with a plurality of second ribs extending in the direction parallel to the rotation axis of the motor 50. The plurality of second ribs is capable of guiding the airflow to flow through the second circuit board 86.

For the snow thrower 100, the airflow inlet 83 is disposed on the back side of the snow thrower 100 which is close to the user and, the airflow outlet 84 is disposed on the down side of the snow thrower 100 which is close to the ground. The airflow outlet 84 is under the airflow inlet 83. The airflow inlet 83 is opened backward and, the airflow outlet 84 is opened downward. When the snow thrower 100 is in the snow throwing state, the airflow inlet 83 faces the user and, the airflow outlet 84 faces the ground, so it avoids the user feeling uncomfortable. And, the airflow inlet and outlet 83, 84 are staggered in the front and back direction, the up and down direction and the left and right direction. Thus, the stroke of the airflow is increased, and the snow thrower 100 can generate a three-dimensional moving airflow in the containing space 205 so as to improve the cooling effect.

As shown in FIG. 25, as an example, the snow thrower 100 includes an air deflector 87 acting as a support and at least partially surrounding the fan 56 of the motor 50. The second cooling element 82 and the second circuit board 86 are mounted on the air deflector 87.

The air deflector 87 is provided with a deflecting channel 88 surrounding the fan 56 circumferentially. The deflecting channel 88 includes a channel outlet 89 opened toward the airflow outlet 84, so that the air deflector 87 allows the airflow to be guided to the airflow outlet 84 after the airflow flows through the second cooling element 82 and the second circuit board 86. The cooling effect is further improved.

It could be understood that, the cooling method can be applied to other hand pushed power tools except the snow thrower, for example, a lawn mower.

Figure 28:
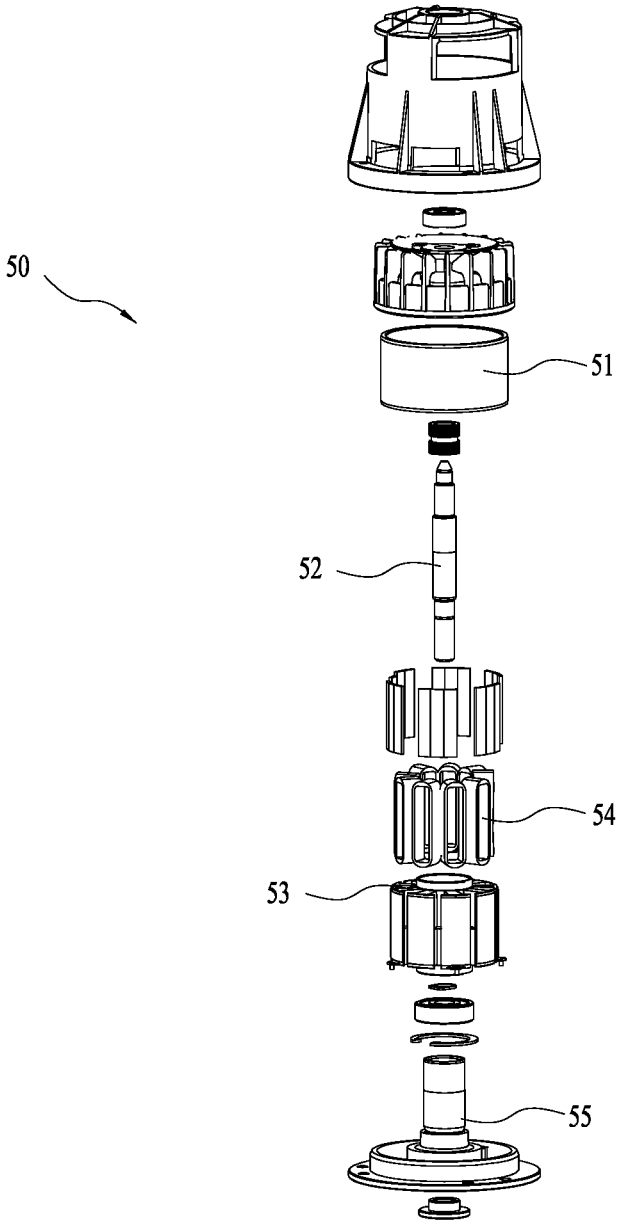
FIG. 28 is an exploded view of the motor of the snow thrower in FIG. 1.

As shown in FIG. 28, the motor 50 is an electric motor, in particular, a brushless electric motor. More specifically, the motor 50 is an outer rotor brushless electric motor. The motor 50 includes a rotor housing 51, a motor shaft 52, a stator core 53, stator coils 54 and a stator support 55. The rotor housing 51 is formed with an accepting chamber. The motor shaft 52 can be rotated around the rotation axis of the motor 50. The stator core 53 is arranged within the accepting chamber. The stator core 53 is formed with a hole at its center, and the stator coils 54 are wound on the stator core 53 and surround the hole. The stator support 55 for mounting the stator core 53 is at least partially disposed on an end of the rotor housing 51. The motor shaft 52 passes through the accepting chamber and the hole.

Because using the outer rotor brushless electric motor to drive the auger 30, the auger 30 can output large torque even the no load speed of the motor 50 is low, so the load capacity is improved. When the maximum output torque is satisfied, the speed of the motor shaft 52 also can be satisfied.

The rotation speed of the motor is greater than or equal to 1000 rpm and less than or equal to 2000 rpm. Further, the rotation speed of the motor is greater than or equal to 1000 rpm and less than or equal to 1500 rpm. The power of the motor is greater than or equal to 1500 W. In detail, the power of the motor is greater than or equal to 1500 W and less than or equal to 3000 W, in particular, greater than or equal to 1500 W and less than or equal to 2000 W. A ratio between the power of the motor and the voltage of the battery packs 300 is greater than 20 W/V. Further, the ratio is greater than 25 W/V. With the power of the motor, the snow thrower 100 has strong power and can throw the snow to the far distance, and the snow thrower 100 has regular working time.

Figure 29:
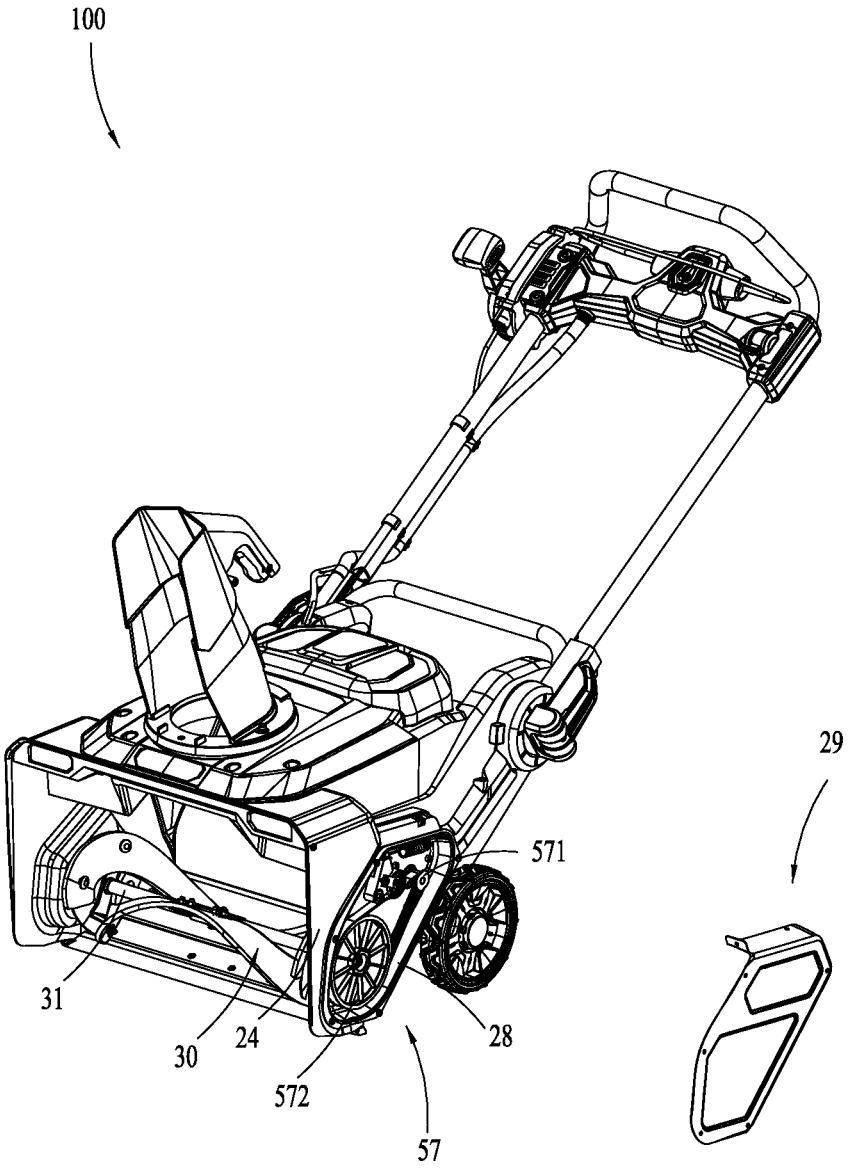
FIG. 29 is a schematic view of a transmission mechanism of the snow thrower in FIG. 1.
Figure 30:
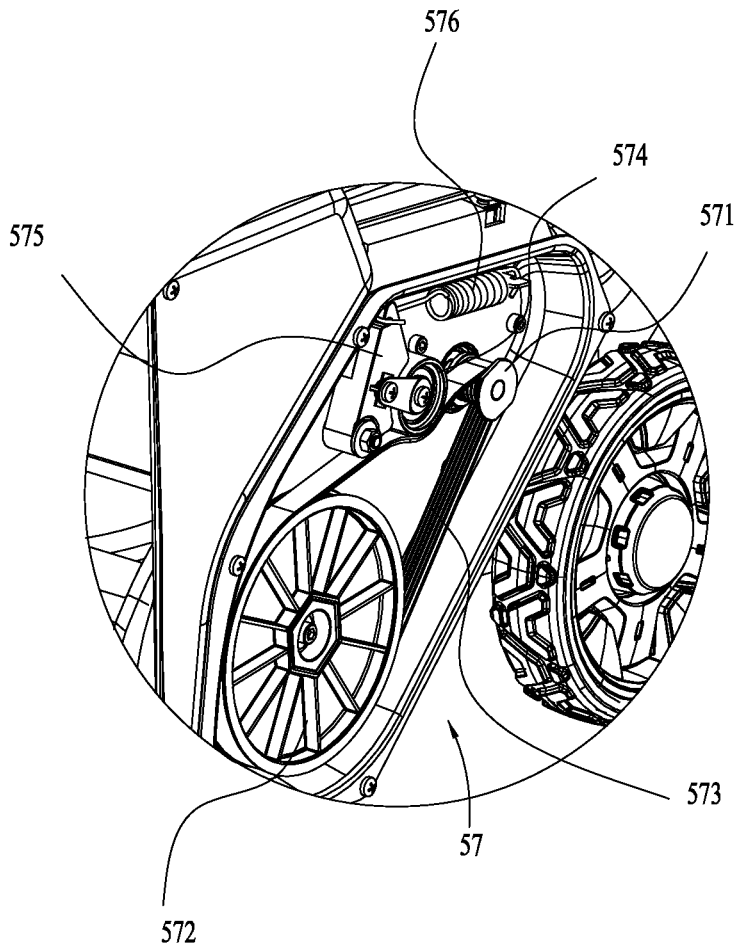
FIG. 30 is a partial enlarged view of the snow thrower in FIG. 29.

Referring to FIGS. 1, 29-30, the snow thrower 100 includes a transmission mechanism 57. The electric energy supplied by the battery packs 300 is converted to motive power and output to the transmission mechanism 57 by the motor 50. Then the transmission mechanism 57 drives the auger 30.

The transmission mechanism 57 is arranged between the motor 50 and the auger 30, which is a belt transmission mechanism. The transmission mechanism 57 includes a first belt pulley 571, a second belt pulley 572, a driving belt 573, a tension pulley 574, a support frame 575 and a biasing element 576. The transmission mechanism 57 is arranged between a protecting cover 29 and the mounting part 28. The protecting cover 29 is configured to protect the transmission mechanism 57, which is made of metal material so as to facilitate cooling. The driving belt 573 is located between the protecting cover 29 and the mounting part 28. The protecting cover 29 covers and protects the driving belt 573.

Specifically, the first belt pulley 571 is rotated with the motor shaft 52 synchronously and, the second belt pulley 572 is rotated with the drive shaft 31 synchronously. The motor shaft 52 is fixedly connected with the first belt pulley 571, and the drive shaft 31 is fixedly connected with the second belt pulley 572. The driving belt 573 is coupled with the first and second belt pulleys 571, 572 so as to transmit the rotation of the motor shaft 52 to the drive shaft 31 through the first belt pulley 571, the driving belt 573 and the second belt pulley 572.

Alternatively, the first housing 24 and the mounting part 28 can be formed with ventilation holes disposed close to the driving belt. The cooling airflow can enter into the snow thrower 100 from the ventilation holes so as to cool the motor 50.

The first belt pulley 571 has a first diameter which is less than a second diameter of the second belt pulley 572. A ratio between the second diameter and the first diameter can be greater than or equal to 5 and less than or equal to 10. A ratio between the rotation speed of the motor 50 and the rotation speed of the auger 30 is greater than or equal to 5 and less than or equal to 10. So, the rotation speed from the motor shaft 52 to the drive shaft 31 is reduced through the transmission mechanism 57 so as to increase the output torque of the snow thrower 100 and improve the effect of snow throwing. The first belt pulley 571 is made of metal material and, the second belt pulley 572 is made of plastic material. Because the first belt pulley 571 is rotated fast, the metal material can avoid it wearing during working.

The driving belt 573 is an inelastic wedge belt. The first and second belt pulleys 571 have constructions matching with the inelastic wedge belt. The inelastic wedge belt can avoid the driving belt 573 changing in the length and contacting area so as to affect the tension force due to environmental change, such as the temperature and humidity.

In order to avoid the driving belt 573 loosing after the snow thrower 100 being used for along time, the tension pulley 574 are arranged to act on the driving belt 573. The tension pulley 574 is connected with the support frame 575. One end of the support frame 575 is connected with the tension pulley 574 and, the other end of the support frame 575 is engaged with the biasing element 576. Under the action of the biasing element 576, the support frame 575 drives the tension pulley 574 to press on the driving belt 573 tightly so as to avoid the driving belt 573 loosing and affect the torsion force.

The drive shaft 31 is driven by the outer rotor motor and the transmission mechanism 57 with the function of speed reducing, so that the output torque of the snow thrower 100 is increase and the effect of snow throwing is improved.

The above illustrates and describes basic principles, main features and advantages of the present invention. Those skilled in the art should appreciate that the above examples do not limit the present invention in any form. Technical solutions obtained by equivalent substitution or equivalent variations all fall within the scope of the present invention.

We claim:

1. A snow thrower, comprising:

a motor;

an auger driven by the motor to rotate;

a housing assembly for accommodating at least a portion of the motor and comprising an auger housing for supporting the auger;

a handle device being rotatably connected to the housing assembly;

a chute device for throwing snow; and an angle adjusting device for adjusting the throwing angle of the chute device, wherein the auger housing comprises a channel having a snow inlet allowing the snow to enter and a snow outlet for communicating the channel and the chute device, the channel further comprising a channel wall, the channel wall comprising:

a back plate portion for guiding at least a part of the snow moved by the auger to the chute device;

a baffle plate portion for directing the snow moved by rotation of ends of the auger; and a side plate portion for connecting the back plate portion and the baffle plate portion, wherein the angle adjusting device comprises:

an adjusting handle for a user to operate;

a handle housing for connecting the adjusting handle to the handle device;

a rotating wheel at least partially arranged in the handle housing;

a connecting wire connecting the rotating wheel and the chute device; and an active wheel rotating synchronously with the adjusting handle and being capable of driving the rotating wheel to rotate, and wherein the active wheel is at least partially arranged in the handle housing.

2. The snow thrower of claim 1, wherein the active wheel is provided with first engaging teeth, the rotating wheel is provided with second engaging teeth for engaging with the first engaging teeth, and the number of the first engaging teeth is greater than the number of the second engaging teeth.

3. The snow thrower of claim 1, wherein the active wheel has the a same rotation axis as the adjusting handle.

4. The snow thrower of claim 1, wherein the handle device is symmetrical about a middle plane, the handle device further comprises a speed regulation switch for adjusting the speed of the motor, and the adjusting handle and a speed regulation switch are disposed on two sides of the middle plane respectively.

5. The snow thrower of claim 1, wherein a ratio between a first maximum rotation angle of the adjusting handle relative to the handle device and a second maximum rotation angle of the chute device relative to the housing assembly is greater than or equal to 0.25 and less than or equal to 1.5.

6. The snow thrower of claim 1, wherein a ratio between a first maximum rotation angle of the adjusting handle relative to the handle device and a second maximum rotation angle of the chute device relative to the housing assembly is greater than or equal to 0.25 and less than or equal to 1.

7. The snow thrower of claim 1, wherein the chute device comprises an outer gear ring, the angle adjusting device further comprises a driving wheel for engaging with the outer gear ring, and the rotating wheel and the driving wheel are respectively arranged at both ends of the connecting wire.

8. The snow thrower of claim 1, wherein the angle adjusting device further comprises a limiting block for limiting the adjusting handle.

9. The snow thrower of claim 8, wherein the active wheel is provided with a plurality of locating recesses for engaging with the limiting block selectively, and the angle adjusting device further comprises a spring arranged between the limiting block and the handle housing.

10. A snow thrower, comprising:

a motor for driving an auger to rotate;

a housing assembly for containing or fixing the motor;

a handle device being rotatably connected to the housing assembly;

a chute device for throwing snow; and an angle adjusting device for adjusting a throwing angle of the chute device, wherein the angle adjusting device comprises:

an adjusting handle for a user to operate;

a handle housing for connecting the adjusting handle to the handle device;

a rotating wheel at least partially arranged in the handle housing;

a connecting member connecting the rotating wheel and the chute device; and an active wheel driven by the adjusting handle and engaging with the rotating wheel to drive the rotating wheel to rotate, and wherein the active wheel is at least partially arranged in the handle housing.

11. The snow thrower of claim 10, wherein the active wheel is provided with first engaging teeth, the rotating wheel is provided with second engaging teeth for engaging with the first engaging teeth, and the number of the first engaging teeth is greater than the number of the second engaging teeth.

12. The snow thrower of claim 10, wherein a rotation axis of the adjusting handle is substantially parallel to a rotation axis of the rotating wheel.

13. A snow thrower, comprising:

a motor;

an auger driven by the motor to rotate;

a housing assembly for accommodating at least a portion of the motor and comprising an auger housing for supporting the auger;

a handle device being rotatably connected to the housing assembly;

a chute device for throwing snow; and an angle adjusting device for adjusting the throwing angle of the chute device, wherein the angle adjusting device comprises:

an adjusting handle for a user to operate;

a handle housing for connecting the adjusting handle to the handle device;

a rotating wheel at least partially arranged in the handle housing;

a connecting wire connecting the rotating wheel and the chute device; and an active wheel driven by the adjusting handle and engaging with the rotating wheel to drive the rotating wheel to rotate, and wherein a ratio between a first maximum rotation angle of the adjusting handle relative to the handle device and a second maximum rotation angle of the chute device relative to the housing assembly is greater than or equal to 0.25 and less than or equal to 1.5.

14. The snow thrower of claim 13, wherein a ratio between a first maximum rotation angle of the adjusting handle relative to the handle device and a second maximum rotation angle of the chute device relative to the housing assembly is greater than or equal to 0.25 and less than or equal to 1.

15. The snow thrower of claim 13, wherein the active wheel is provided with first engaging teeth, the rotating wheel is provided with second engaging teeth for engaging with the first engaging teeth, and the number of the first engaging teeth is greater than the number of the second engaging teeth.

16. The snow thrower of claim 13, wherein the active wheel has the same rotation axis as the adjusting handle.

17. The snow thrower of claim 13, wherein the handle device is symmetrical about a middle plane, the handle device further comprises a speed regulation switch for adjusting a speed of the motor, and the adjusting handle and the speed regulation switch are disposed on two sides of the middle plane respectively.

18. The snow thrower of claim 13, wherein the chute device comprises an outer gear ring, the angle adjusting device further comprises a driving wheel for engaging with the outer gear ring, and the rotating wheel and the driving wheel are respectively arranged at both ends of the connecting wire.

19. The snow thrower of claim 13, wherein the angle adjusting device further comprises a limiting block for limiting the adjusting handle.

20. The snow thrower of claim 19, wherein the active wheel is provided with a plurality of locating recesses for engaging with the limiting block selectively, and the angle adjusting device further comprises a spring arranged between the limiting block and the handle housing.

* * * * *